US008677785B2

(12) United States Patent
Han et al.

(10) Patent No.: US 8,677,785 B2
(45) **Date of Patent: *Mar. 25, 2014**

(54) LAUNDRY MACHINE

(75) Inventors: Dong Joo Han, Gyeongsangnam-do (KR); Young Bok Son, Gyeongsangnam-do (KR); Jae Yoen Lim, Gyeongsangnam-do (KR); Jong Chul Bang, Gyeongsangnam-do (KR); Ki Chul Cho, Gyeongsangnam-do (KR); In Ho Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 308 days.

This patent is subject to a terminal disclaimer.

(21) Appl. No.: 12/432,455

(22) Filed: Apr. 29, 2009

(65) Prior Publication Data

US 2010/0083711 A1 Apr. 8, 2010

(30) Foreign Application Priority Data

| | | |
|---|---|---|
| Apr. 30, 2008 | (KR) | 10-2008-0040598 |
| Apr. 30, 2008 | (KR) | 10-2008-0040600 |
| Apr. 30, 2008 | (KR) | 10-2008-0040609 |
| Apr. 30, 2008 | (KR) | 10-2008-0040612 |
| Apr. 30, 2008 | (KR) | 10-2008-0040613 |
| Oct. 1, 2008 | (KR) | 10-2008-0096564 |
| Apr. 28, 2009 | (KR) | 10-2009-0036853 |

(51) Int. Cl.
*D06F 29/00* (2006.01)
*F26B 11/02* (2006.01)

(52) U.S. Cl.
USPC ..... 68/3 R; 68/19.1; 68/20; 34/595; 34/606

(58) Field of Classification Search
None
See application file for complete search history.

(56) References Cited

U.S. PATENT DOCUMENTS

| | | | |
|---|---|---|---|
| 2,165,487 | A | 7/1939 | Johnson |
| 2,351,429 | A | 9/1942 | Huebsch |
| 2,369,366 | A | 2/1945 | O'Neill |
| 2,486,058 | A | 10/1949 | Patterson et al. |
| 2,543,579 | A | 2/1951 | Kauffmann, II |
| 2,547,238 | A | 4/1951 | Tremblay |
| 2,566,488 | A | 9/1951 | Gould |
| 2,611,192 | A | 9/1952 | Huebsch |
| 2,687,578 | A | 8/1954 | Richterkessing |
| 2,707,837 | A | 5/1955 | Robinson et al. |
| 2,716,820 | A | 9/1955 | Bourner |

(Continued)

FOREIGN PATENT DOCUMENTS

| | | | |
|---|---|---|---|
| AR | 197471 | A1 | 4/1974 |
| AR | 198520 | A1 | 6/1974 |

(Continued)

OTHER PUBLICATIONS

English Machine Translation of JP 2006-021028 A.*

*Primary Examiner* — Nicole Blan
(74) *Attorney, Agent, or Firm* — Birch, Stewart, Kolasch & Birch, LLP

(57) ABSTRACT

A laundry machine includes a first laundry treatment space configured to receive laundry therein, a second laundry treatment space configured to receive laundry therein, and an air supply unit configured to supply air to the second laundry treatment space, the air supply unit comprising a fan, a heating part, a first sensor part for sensing a temperature of air supplied by the air supply unit, and a control part for controlling a temperature of the supplied air to be within a predetermined range.

16 Claims, 15 Drawing Sheets

(56) References Cited

U.S. PATENT DOCUMENTS 2,722,057 A 11/1955 Pugh
2,727,315 A 12/1955 Candor
2,728,481 A 12/1955 Robinson et al.
2,742,708 A 4/1956 McCormick
2,752,004 A 6/1956 Hullar
2,795,055 A 6/1957 Huebsch
2,813,353 A 11/1957 McMillan
2,816,429 A 12/1957 Kurlancheek
2,817,157 A 12/1957 McCormick
2,817,501 A 12/1957 Schubert
2,843,945 A 7/1958 Whyte
2,861,355 A 11/1958 Douglas
2,867,430 A 1/1959 Hullar
2,903,799 A 9/1959 Sachaczenski
2,904,895 A 9/1959 Bochan
2,985,967 A 9/1961 Pataillot et al.
3,000,108 A 9/1961 Jones et al.
3,001,295 A 9/1961 Miller
3,023,514 A 3/1962 Gibson
3,061,942 A 11/1962 Scofield
3,064,358 A 11/1962 Giuffre
3,121,000 A 2/1964 Hubbard
3,383,776 A 5/1968 Wilhoyte
3,402,477 A * 9/1968 Hubbard ..... 34/543
3,555,701 A 1/1971 Hubbard
3,579,851 A 5/1971 Elmy
3,789,514 A 2/1974 Faust et al.
3,840,998 A 10/1974 Marcussen
4,557,058 A 12/1985 Ozawa et al.
4,653,200 A 3/1987 Werner
5,062,219 A 11/1991 Harris et al.
5,136,792 A 8/1992 Janecke
5,165,181 A 11/1992 Acosta, Sr. et al.
5,279,047 A 1/1994 Janecke
5,443,538 A 8/1995 Little
5,560,120 A 10/1996 Swanson et al.
5,664,339 A 9/1997 Swanson et al.
5,784,901 A 7/1998 Yanase et al.
6,016,610 A 1/2000 Sears
6,094,839 A 8/2000 Nikolov
6,151,795 A 11/2000 Hoffman et al.
6,374,644 B1 4/2002 Rhode et al.
6,618,887 B2 9/2003 Kim et al.
6,671,978 B1 1/2004 McGowan et al.
6,732,553 B2 5/2004 Rhode et al.
6,978,556 B1 12/2005 Cornelious
7,036,243 B2 5/2006 Doh et al.
7,055,262 B2 6/2006 Goldberg et al.
7,065,904 B2 6/2006 Lee et al.
7,251,905 B2 8/2007 Doh et al.
7,281,775 B2 10/2007 Yang
7,404,303 B1 7/2008 Barbosa et al.
7,497,030 B2 3/2009 Belgard
7,520,145 B2 4/2009 Hong et al.
7,591,082 B2 9/2009 Lee et al.
7,624,601 B2 12/2009 Ikemizu et al.
7,644,515 B2 1/2010 Doh
7,665,225 B2 2/2010 Goldberg et al.
7,665,227 B2 2/2010 Wright et al.
7,673,358 B2 3/2010 Dietz et al.
7,707,858 B2 5/2010 Jeon et al.
7,707,860 B2 5/2010 Hong et al.
7,735,345 B2 6/2010 Wright et al.
7,748,139 B2 7/2010 Hong et al.
7,836,607 B2 11/2010 Kim
7,849,717 B2 12/2010 Sunshine
7,895,770 B2 3/2011 Bae et al.
7,913,419 B2 3/2011 Tomasi et al.
7,921,578 B2 4/2011 McAllister et al.
7,921,679 B2 4/2011 Jo
8,250,885 B2 * 8/2012 Han et al. ..... 68/3 R
8,307,567 B2 * 11/2012 Han et al. ..... 34/73
8,387,419 B2 * 3/2013 Han et al. ..... 68/3 R
2002/0017117 A1 2/2002 Sunshine et al.
2002/0092329 A1 7/2002 Rhode et al.
2002/0154011 A1 10/2002 Pasin et al.
2003/0079368 A1 5/2003 Hoffman
2004/0134237 A1 7/2004 Sunshine et al.
2005/0066538 A1 3/2005 Goldberg et al.
2005/0066999 A1 3/2005 Dietz et al.
2005/0120585 A1 6/2005 Lee et al.
2005/0126035 A1 6/2005 Lee et al.
2005/0132593 A1 6/2005 Doh et al.
2005/0132594 A1 6/2005 Doh et al.
2005/0132604 A1 6/2005 Hong et al.
2006/0075790 A1 4/2006 Jeon et al.
2006/0112585 A1 6/2006 Choi et al.
2006/0123853 A1 6/2006 Hong et al.
2006/0156765 A1 7/2006 Sunshine et al.
2006/0179676 A1 8/2006 Goldberg et al.
2006/0186222 A1 8/2006 Ikemizu et al.
2006/0289533 A1 12/2006 Park et al.
2007/0062513 A1 3/2007 Gagas
2007/0068034 A1 3/2007 Kim
2007/0113419 A1 5/2007 Belgard
2007/0119072 A1 5/2007 Kim
2007/0144031 A1 6/2007 Lee
2007/0151041 A1 7/2007 McAllister et al.
2007/0151120 A1 7/2007 Tomasi et al.
2007/0151129 A1 7/2007 McAllister et al.
2007/0151301 A1 7/2007 Kendall et al.
2007/0151310 A1 7/2007 Wright et al.
2007/0151311 A1 7/2007 McAllister et al.
2007/0151312 A1 7/2007 Bruce et al.
2007/0163093 A1 7/2007 Wright et al.
2007/0163094 A1 7/2007 Wright et al.
2007/0163095 A1 7/2007 McAllister et al.
2007/0163096 A1 7/2007 McAllister et al.
2007/0163097 A1 7/2007 Metcalfe et al.
2007/0163098 A1 7/2007 Tomasi et al.
2007/0249212 A1 10/2007 Buecker et al.
2008/0006224 A1 * 1/2008 Ahn et al. ..... 122/4 A
2008/0052950 A1 * 3/2008 Park et al. ..... 34/524
2008/0053162 A1 3/2008 Park et al.
2008/0053163 A1 3/2008 Park et al.
2008/0053164 A1 3/2008 Park et al.
2008/0053166 A1 * 3/2008 Lim ..... 68/5
2008/0141550 A1 6/2008 Bae et al.
2008/0141552 A1 6/2008 Bae et al.
2008/0141554 A1 6/2008 Bae et al.
2008/0141557 A1 6/2008 Son et al.
2008/0141558 A1 6/2008 Bae et al.
2008/0141734 A1 6/2008 Son et al.
2008/0148494 A1 6/2008 Son et al.
2008/0163651 A1 7/2008 Jeong et al.
2008/0168679 A1 7/2008 Son et al.
2008/0252189 A1 10/2008 Regan
2008/0256989 A1 10/2008 Jeong et al.
2008/0271263 A1 11/2008 Bae et al.
2008/0271336 A1 11/2008 Doh
2008/0271500 A1 11/2008 Ahn
2008/0276659 A1 11/2008 Bae et al.
2008/0276660 A1 11/2008 Bae et al.
2008/0276661 A1 11/2008 Bae et al.
2008/0282745 A1 11/2008 Han et al.
2009/0057527 A1 3/2009 Jo
2009/0113745 A1 5/2009 Choi et al.
2009/0113755 A1 5/2009 Choi et al.
2009/0126222 A1 5/2009 Bae et al.
2009/0126421 A1 5/2009 Kim et al.
2009/0133281 A1 5/2009 Yoon et al.
2009/0133284 A1 5/2009 Belgard
2009/0158616 A1 6/2009 Ricklefs et al.
2009/0193856 A1 8/2009 Park et al.
2009/0235551 A1 9/2009 Jo et al.
2009/0241606 A1 10/2009 Yoo et al.
2009/0260246 A1 10/2009 Bae et al.
2009/0265953 A1 10/2009 Bae et al.
2009/0277036 A1 11/2009 Lee et al.
2009/0277037 A1 11/2009 Lim
2009/0288456 A1 11/2009 Bae et al.
2009/0320313 A1 12/2009 Bae et al.
2010/0000112 A1 1/2010 Carow et al.
2010/0000114 A1 1/2010 Dalton et al.

(56) References Cited

U.S. PATENT DOCUMENTS

| | | | |
|---|---|---|---|
| 2010/0000117 | A1 | 1/2010 | Choi et al. |
| 2010/0005681 | A1 | 1/2010 | Jo et al. |
| 2010/0011609 | A1 | 1/2010 | Park et al. |
| 2010/0018262 | A1 | 1/2010 | Beihoff et al. |
| 2010/0024243 | A1 | 2/2010 | Ricklefs et al. |
| 2010/0077801 | A1 | 4/2010 | Son et al. |
| 2010/0083521 | A1 | 4/2010 | Han et al. |
| 2010/0083708 | A1 | 4/2010 | Han et al. |
| 2010/0083709 | A1 | 4/2010 | Han et al. |
| 2010/0083710 | A1 | 4/2010 | Han et al. |
| 2010/0083711 | A1 | 4/2010 | Han et al. |
| 2010/0115784 | A1 | 5/2010 | Jo et al. |
| 2010/0146812 | A1 | 6/2010 | Ahn et al. |
| 2010/0182136 | A1 | 7/2010 | Pryor |
| 2010/0186176 | A1 | 7/2010 | Wright et al. |
| 2010/0192397 | A1 | 8/2010 | Kim et al. |
| 2010/0206016 | A1 | 8/2010 | Bae et al. |
| 2010/0231506 | A1 | 9/2010 | Pryor |
| 2010/0281929 | A1 | 11/2010 | Han et al. |
| 2010/0327766 | A1 | 12/2010 | Recker et al. |
| 2011/0005276 | A1 | 1/2011 | Moon et al. |
| 2011/0016928 | A1 | 1/2011 | Beihoff et al. |
| 2011/0030147 | A1 | 2/2011 | Yoo et al. |
| 2011/0030428 | A1 | 2/2011 | Han et al. |
| 2011/0047814 | A1 | 3/2011 | Watson et al. |
| 2011/0067457 | A1 | 3/2011 | Han et al. |
| 2011/0083338 | A1 | 4/2011 | Carow et al. |

FOREIGN PATENT DOCUMENTS

| | | | | |
|---|---|---|---|---|
| CN | 2157212 | Y | | 2/1994 |
| CN | 1349012 | A | | 5/2002 |
| CN | 1966839 | A | | 5/2007 |
| CN | 101153455 | A | | 4/2008 |
| CN | 101153456 | A | | 4/2008 |
| DE | 203 02 572 | U1 | | 4/2003 |
| EP | 0627519 | A1 | | 12/1994 |
| EP | 0 666 355 | A1 | | 9/1995 |
| EP | 1353004 | A1 | | 10/2003 |
| EP | 1524356 | A1 | | 4/2005 |
| EP | 1726703 | A1 | | 11/2006 |
| FR | 1 473 011 | | | 2/1967 |
| GB | 1510528 | A | | 5/1978 |
| GB | 1 545 078 | | | 5/1979 |
| JP | 54-108060 | A | | 8/1979 |
| JP | 60-238693 | A | | 11/1985 |
| JP | 60-238695 | A | | 11/1985 |
| JP | 1-266000 | A | | 10/1989 |
| JP | 2-128797 | A | | 5/1990 |
| JP | 3-126490 | A | | 5/1991 |
| JP | 3-289999 | A | | 12/1991 |
| JP | 4-126195 | A | | 4/1992 |
| JP | 4-338495 | A | | 11/1992 |
| JP | 4-367697 | A | | 12/1992 |
| JP | 5-49795 | A | | 3/1993 |
| JP | 5-49796 | A | | 3/1993 |
| JP | 6-293 | A | | 1/1994 |
| JP | 6-134187 | A | | 5/1994 |
| JP | 6-190193 | A | | 7/1994 |
| JP | 6-254296 | A | | 9/1994 |
| JP | 6-277396 | A | | 10/1994 |
| JP | 07-148394 | A | | 6/1995 |
| JP | 04-187194 | A | | 8/1995 |
| JP | 8-155194 | A | | 6/1996 |
| JP | 8-196798 | A | | 8/1996 |
| JP | 8-229298 | A | | 9/1996 |
| JP | 2006021028 | A | * | 1/2006 |
| JP | 5192586 | B2 | | 5/2013 |
| KR | 10-2001-0088209 | A | | 9/2001 |
| KR | 10-2003-0016860 | A | | 3/2003 |
| KR | 10-2005-0115968 | A | | 12/2005 |
| KR | 10-2005-0115969 | A | | 12/2005 |
| RU | 2291922 | C2 | | 1/2007 |
| RU | 2317357 | C2 | | 2/2008 |
| SU | 1687682 | A1 | | 10/1991 |
| WO | WO 2007/033454 | A1 | | 3/2007 |
| WO | WO 2008/013411 | A2 | | 1/2008 |
| WO | WO 2008/013413 | A2 | | 1/2008 |
| WO | WO 2008/023910 | A2 | | 2/2008 |
| WO | WO 2008/123699 | A2 | | 10/2008 |
| WO | WO 2008/127027 | A2 | | 10/2008 |

* cited by examiner

LAUNDRY MACHINE

CROSS REFERENCE TO RELATED APPLICATION

This application claims the benefit of the Korean Patent Application Nos. 10-2008-0040598, filed on Apr. 30, 2008, 10-2008-0040600, filed on Apr. 30, 2008, 10-2008-0040609, filed on Apr. 30, 2008, 10-2008-0040612, filed on Apr. 30, 2008, 10-2008-0040613, filed on Apr. 30, 2008, 10-2008-0096564, filed on Oct. 1, 2008 and 10-2009-0036853, filed on Apr. 28, 2009 which are hereby incorporated by reference as if fully set forth herein.

BACKGROUND OF THE DISCLOSURE

1. Field of the Disclosure

The present invention relates to laundry machine.

2. Discussion of the Related Art

Generally, laundry machines are home appliances that are used to clean laundry by washing and drying laundry, using detergent and mechanical friction. Laundry machines are categorized into washing machines, dryers and single appliances performing both washing and drying functions.

SUMMARY OF THE DISCLOSURE

The present invention is directed to a laundry machine.

An object of the present invention is to provide a laundry machine with enhanced laundering efficiency, and which has an improved overall exterior appearance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet; a partition partitioning the cabinet into first space for main treating of laundry and second space for auxiliary treating of laundry; a air supply unit provided in a lower portion of the first space and selectively heating air inside the first space, the air supply unit comprising a heating part and a fan; a first sensor part sensing a temperature of air supplied by the air supply unit; and a control part comparing the temperature sensed by the first sensor part with a first reference temperature in case of treating laundry by using the air supply unit and controlling the heating part of the air supply unit according to the result of the comparison.

The control part may control the fan to be on, if treating laundry by the air supply unit starts, and the control part may control the heating part to be on, in case the temperature sensed by the first sensor part is below the first reference temperature, and the control part may control only the fan to be on, in case the temperature sensed by the first sensor part is over the first reference temperature.

In case the heating part operates, the control part may compare the temperature sensed by the first sensor part with a second reference temperature and in case the temperature is over the first reference temperature, the control part may control the heating part to be off.

The driving time of the fan may be substantially longer than the driving time of the heating part.

The control part may control the temperatures sensed by the first sensor part to form a predetermined range. The control part may control the heating part to be turned on such that the temperatures sensed by the first sensor part substantially form a range with difference of 10 to 20 ° C.

The first sensor part may be provided at an end of a path through which air is discharged from the air supply unit.

The laundry machine may further include a sensing part sensing whether a drawer detachably provided in the second space is moved open. Here, the control part may control the heating part and the fan of the air supply unit to be off, in case the drawer is moving open during a course of the air supply unit.

The control part may control the heating part to be off and the fan to be off in a predetermined time period after the heating part is turned off.

The laundry machine may further include a display part displaying information on the air supply unit. Here, the control part may display the rest of the operation time of the air supply unit in the display part.

The laundry machine may further include a second sensor part sensing a temperature of the heating part and the control part may control the heating part to be off in case that the heating part is overheated according to the result of the sensing performed by the second sensor part.

The laundry machine may further include an off-unit turning off the heating part in case the heating part is overheated over a predetermined temperature.

The control part may control the heating part and the fan of the air supply unit to be on if treating laundry by the air supply unit starts and the control part may compare the temperature sensed by the first sensor part with the first reference temperature and a second reference temperature and the control part controls the heating part and the fan according to the result of the comparison.

The control part may control the heating part to be off and only the fan to be on, in case the temperature sensed by the first sensor part is over the second reference temperature. The control part may control the heating part to be on again, in case the temperature sensed by the first sensor part is below the first reference temperature.

In another aspect of the present invention, a laundry machine includes a cabinet; a partition partitioning the cabinet into first space for main treating of laundry and second space for auxiliary treating of laundry; a air supply unit provided in a lower portion of the first space and selectively heating air inside the first space to supply hot air to the second space downward, the air supply unit comprising a heating part and a fan; a first sensor part sensing a temperature of air inside the second space; and a control part comparing the temperature sensed by the first sensor part with a first reference temperature, in case of laundry treating by using the air supply unit, and controlling the heating part of the air supply unit according to the result of the comparison.

The control part may control the fan to be on, in case of treating laundry by using the air supply unit, and the control part may control the heating part to be on, in case the temperature sensed by the first sensor part is below the first reference temperature, and the control part may control only the fan to be on, in case the temperature sensed by the first sensor part is over the first reference temperature.

The control part may compare the temperature sensed by the first sensor part with a second reference temperature, in case the heating part operates, and the control part may control the heating part to be off, in case the temperature sensed by the first sensor part is over the second reference temperature. The driving time of the fan may be substantially longer than the driving time of the heating part.

The control part may control the temperatures sensed by the first sensor part to form a predetermined range. The control part may control the heating part to be turned on such that the temperatures sensed by the first sensor part substantially form a range with difference of 10 to 20° C.

The laundry machine may further include a drawer detachably provided in the second space and the first sensor part is provided in a upper portion of the second space toward the second space.

The control part may control the heating part and the fan of the air supply unit to be on if treating laundry by the air supply unit starts, and the control part may compare the temperature sensed by the first sensor part with the first reference temperature and a second reference temperature and the control part may control the heating part and the fan according to the result of the comparison.

The control part may control the heating part to be off and only the fan to be on, in case the temperature sensed by the first sensor part is over the second reference temperature, and the control part may control the heating part to be on again, in case the temperature sensed by the first sensor part is below the first reference temperature.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

Figure 1:
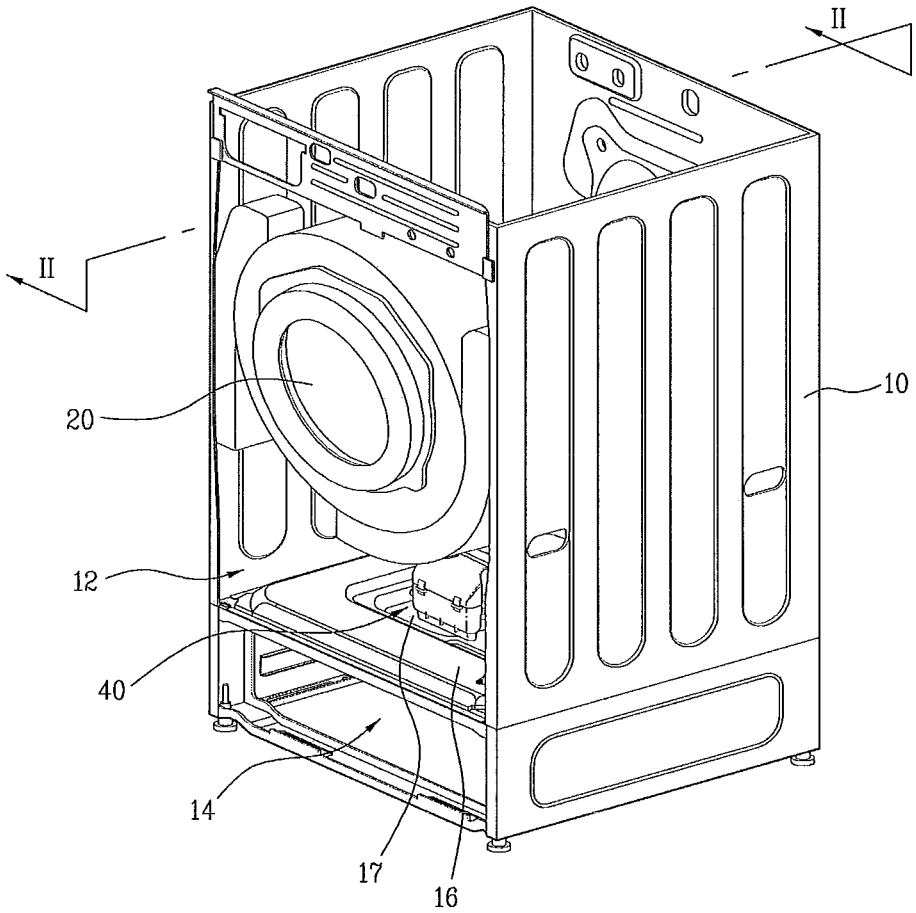
FIG. 1 is a perspective view illustrating a laundry machine according to an exemplary embodiment of the present invention.
Figure 5:
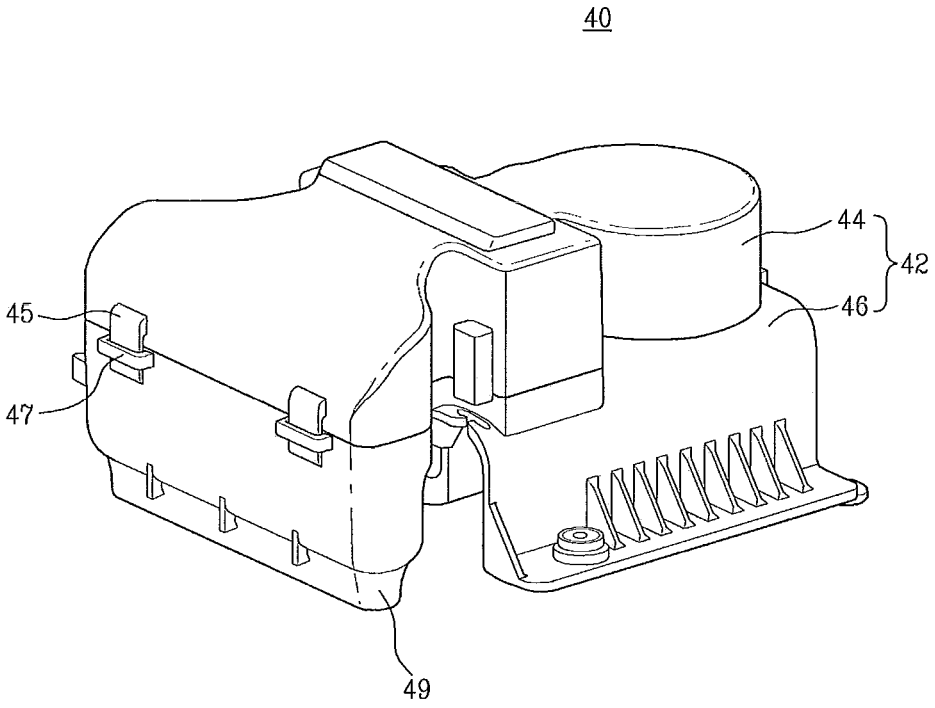
Figure 6:
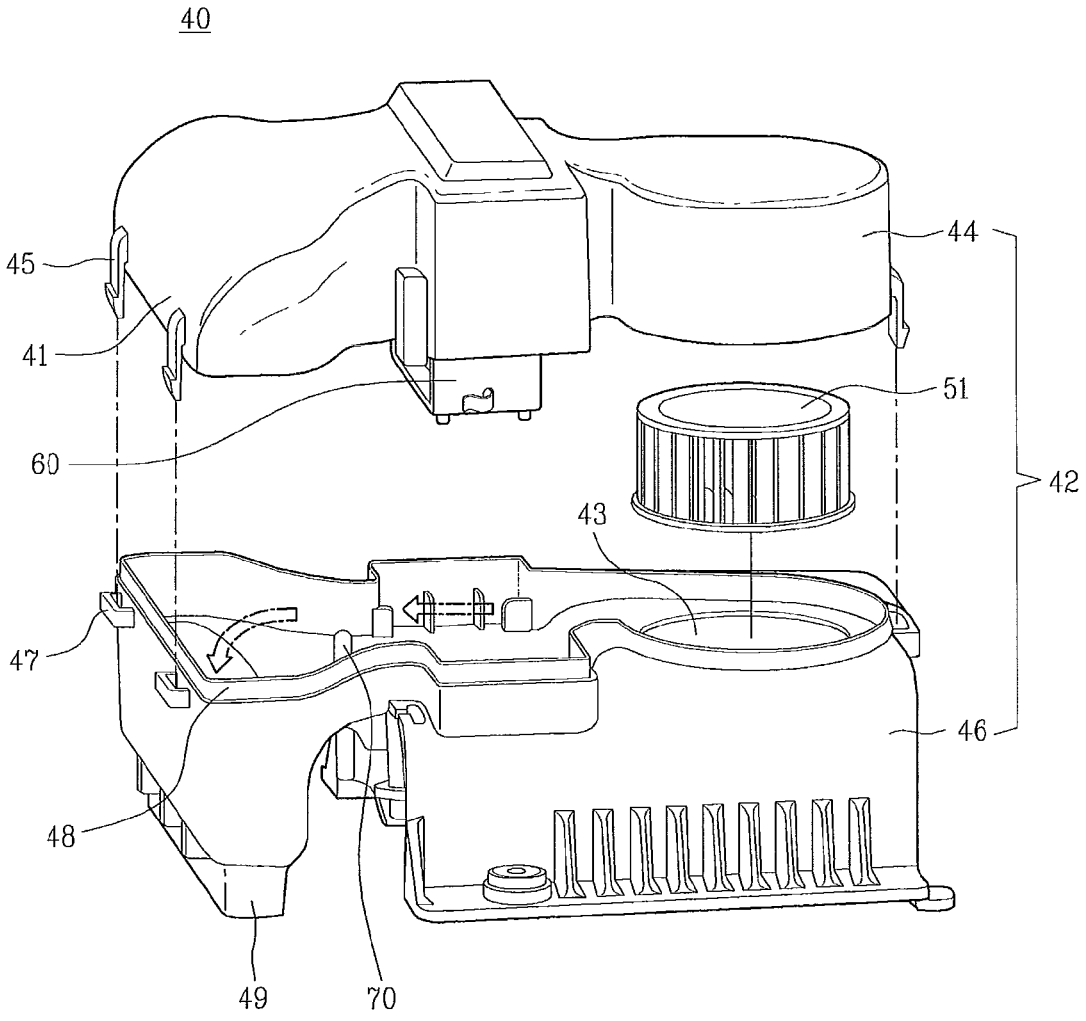
Figure 7:
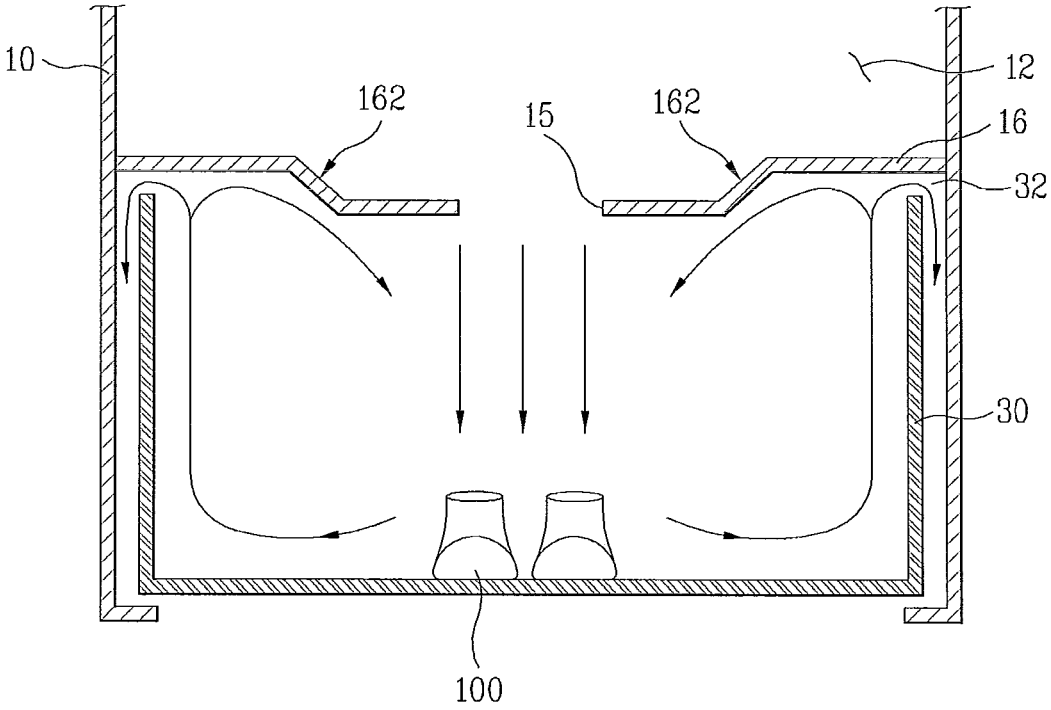
Figure 8:
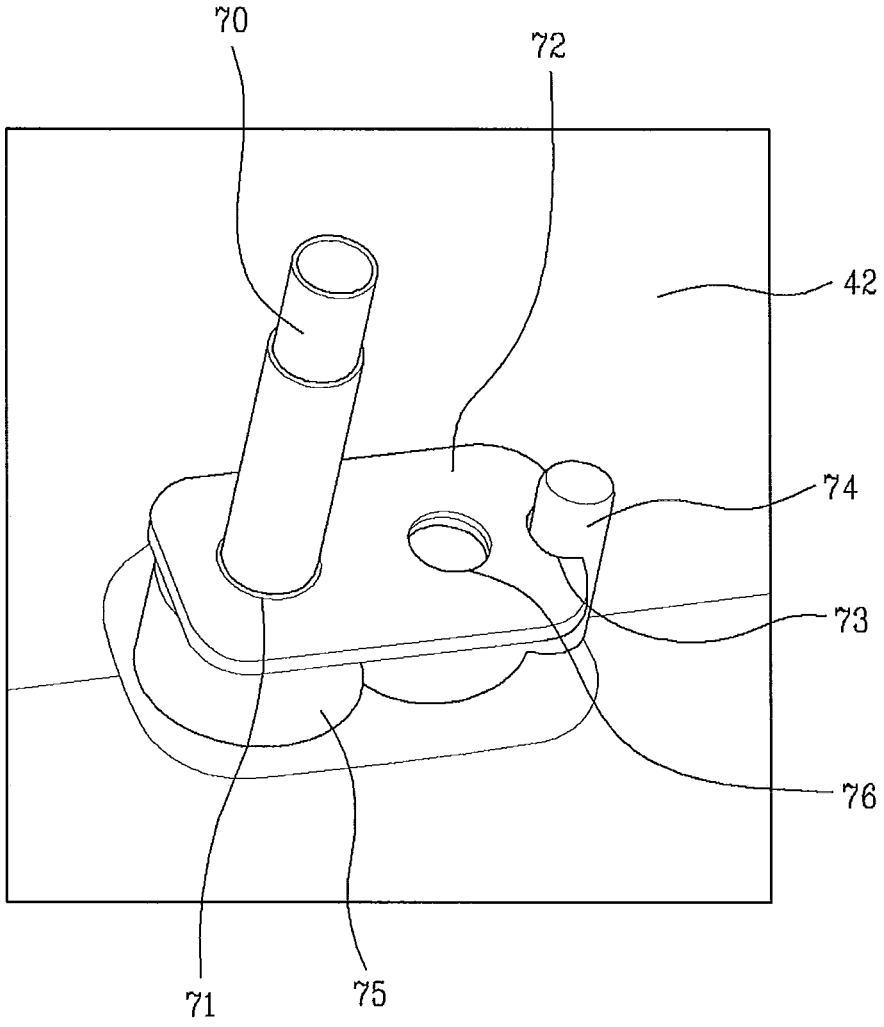
Figure 9:
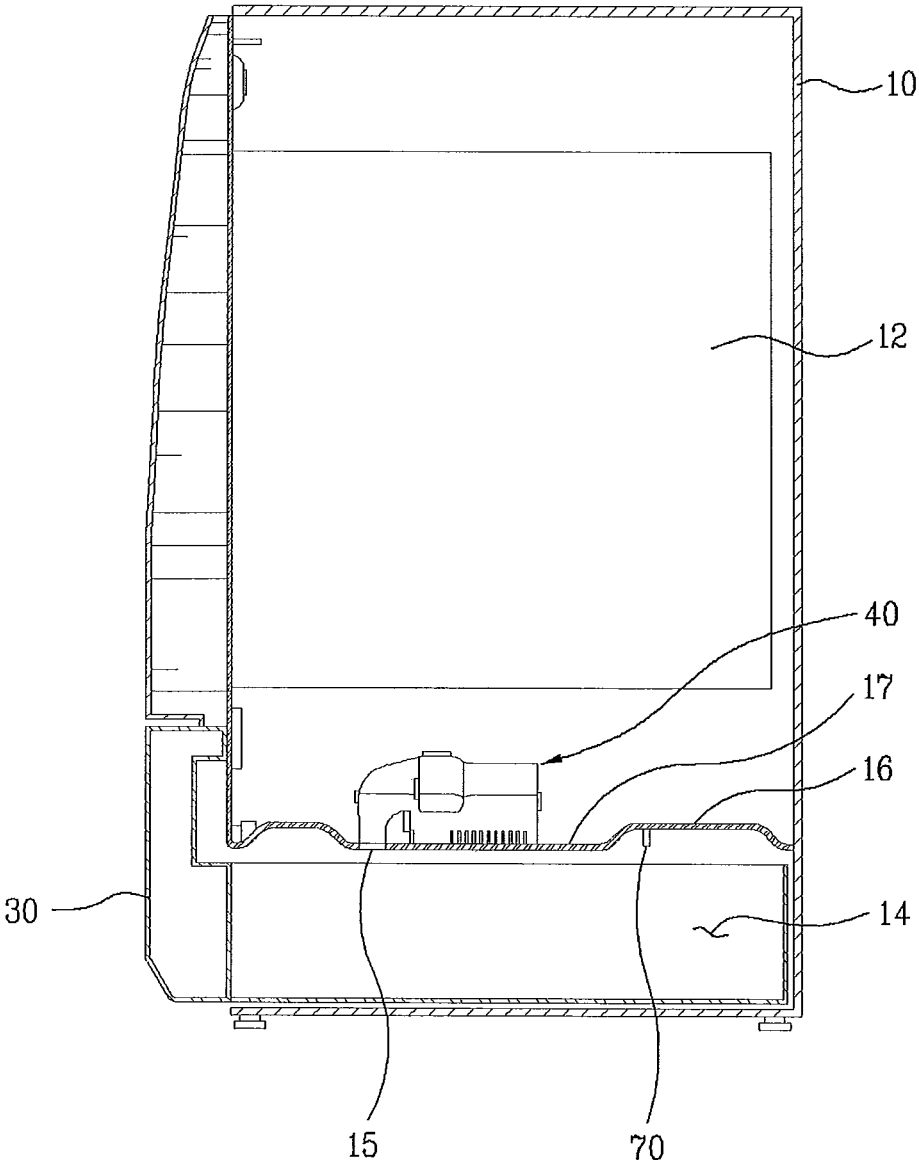
Figure 10:
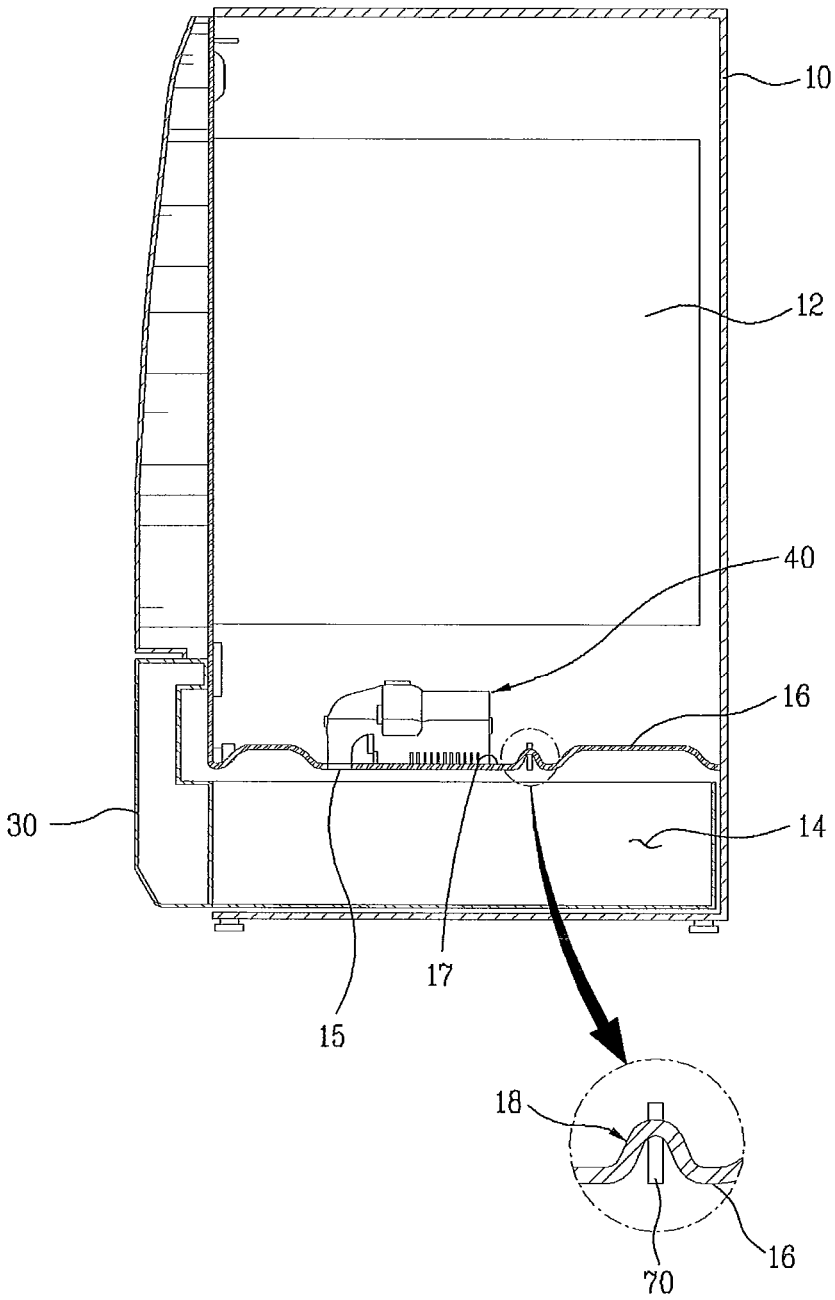
Figure 11:
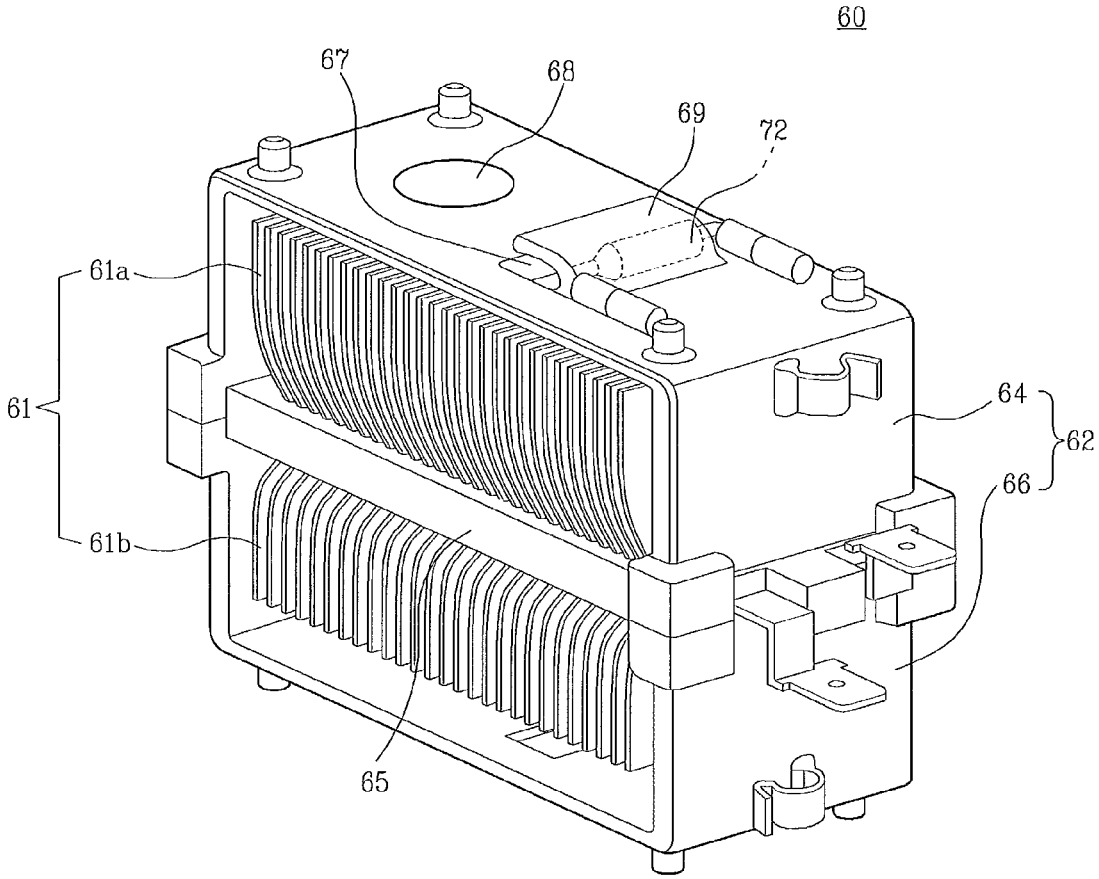
Figure 12:
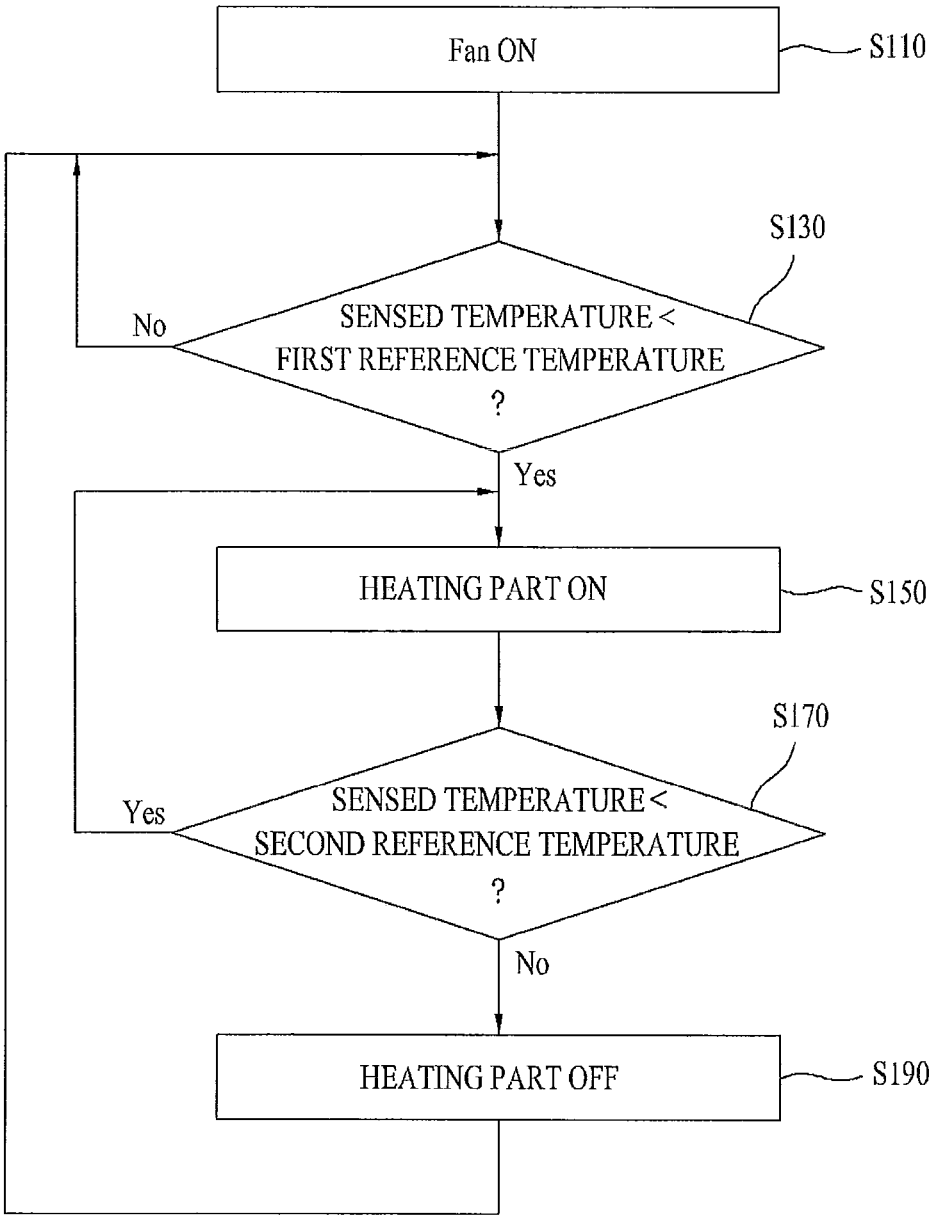
Figure 13:
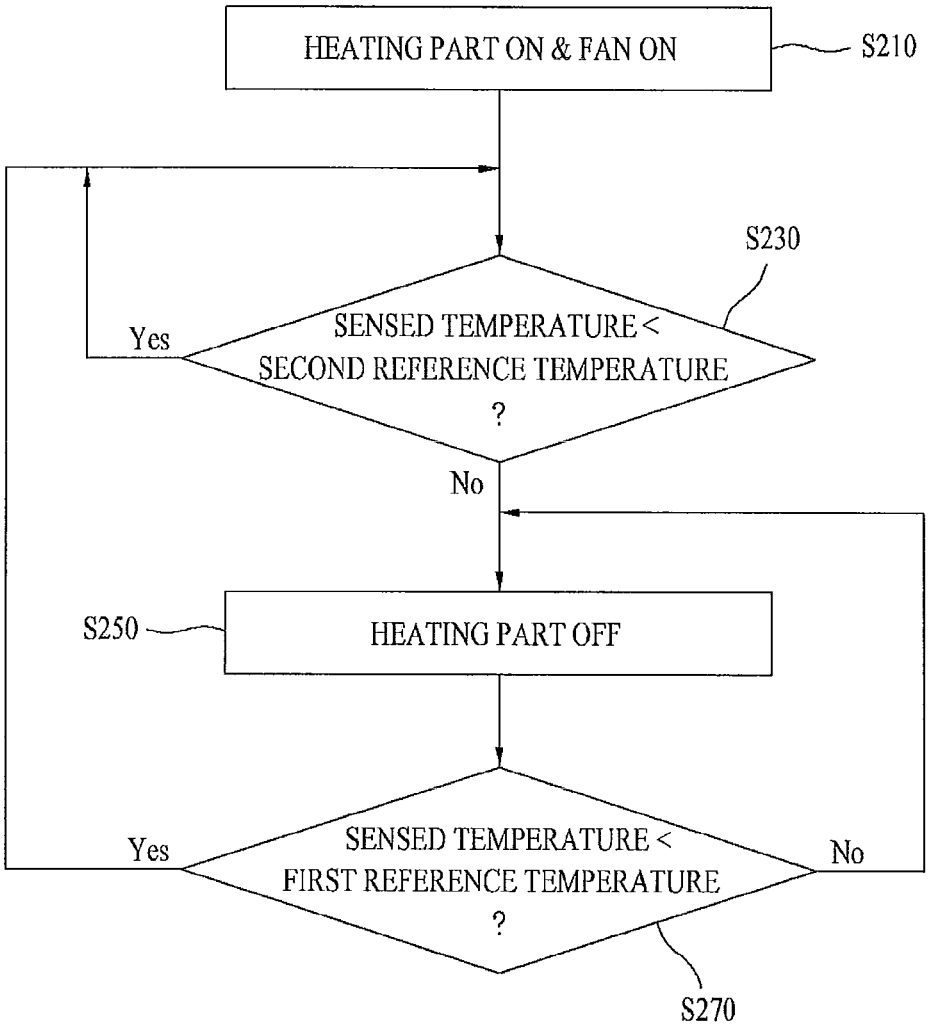
Figure 14:
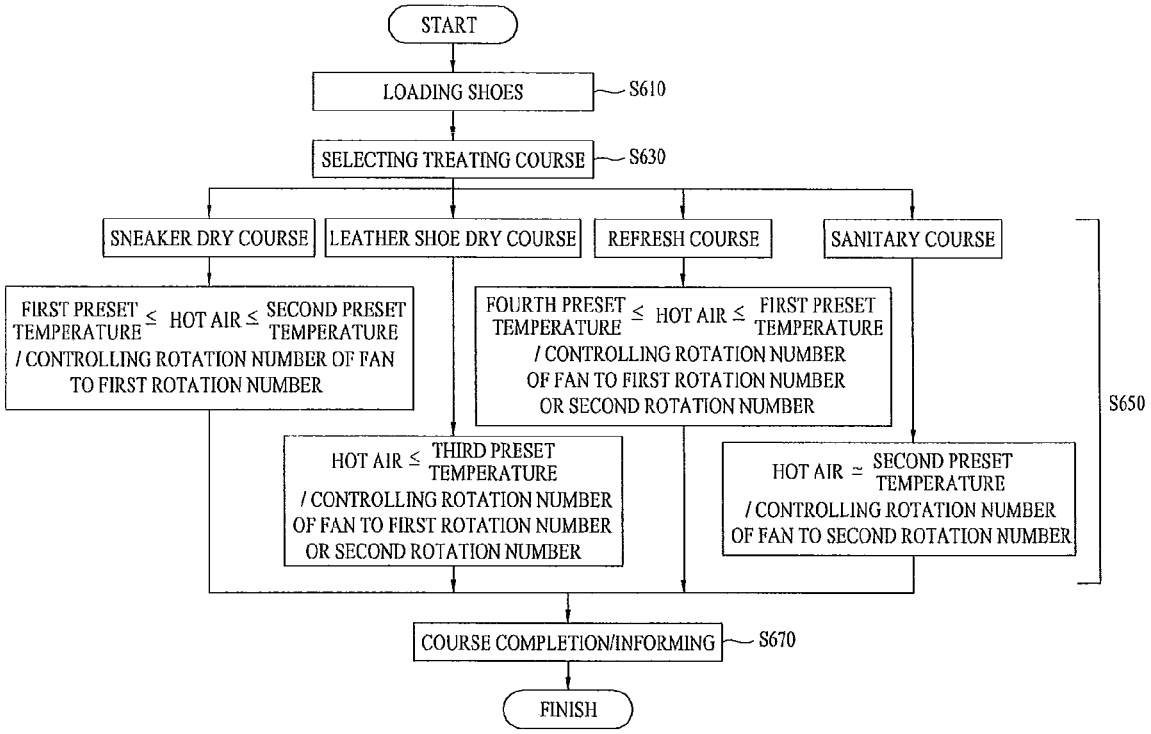
Figure 15:
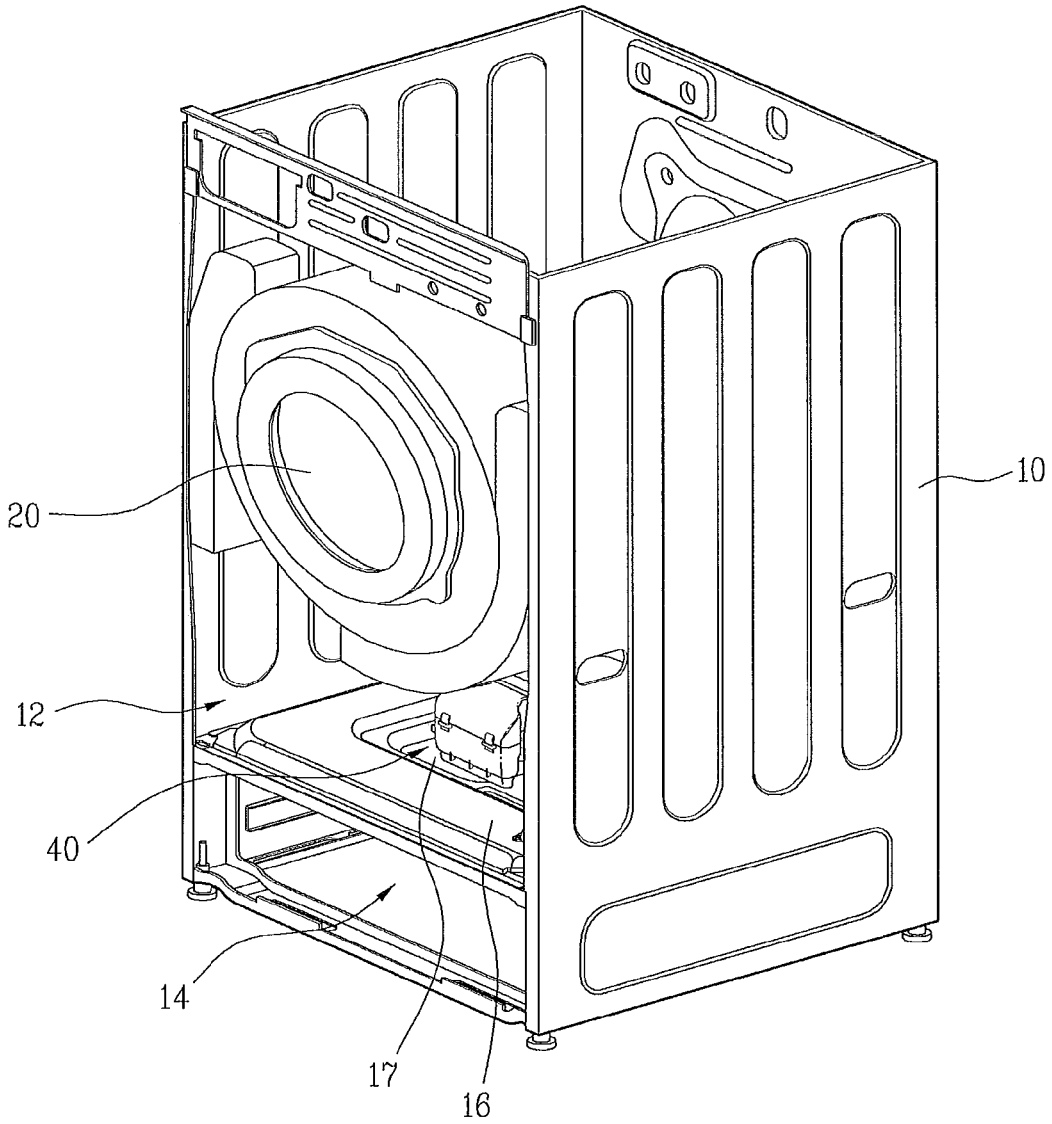

1;

FIG. 5 is a perspective view illustrating a air supply unit shown in FIG. 1;

FIG. 6 is a perspective view illustrating an upper housing of FIG. 5 that is separated;

FIG. 7 is a diagram schematically illustrating air flow inside the drawer;

FIG. 8 is a perspective view illustrating a temperature sensor shown in FIG. 6 that is installed;

FIGS. 9 and 10 are sectional views partially illustrating a first sensing part according to another embodiment;

FIG. 11 is a perspective view illustrating a heating part shown in FIG. 6;

FIG. 12 is a flow chart illustrating operational flow of the laundry machine according to an exemplary embodiment of the present invention;

FIG. 13 is a flow chart illustrating operational flow of the laundry machine according to another embodiment of the present invention;

FIG. 14 is a flow chart illustrating operational flow of the laundry machine according to a further embodiment; and FIG. 15 is a perspective view illustrating a laundry machine according to an exemplary embodiment of the present invention

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts. A configuration of a laundry machine a control method according to this embodiment may be applicable to will be described first and a control method of the laundry machine will be described later.

Figure 2:
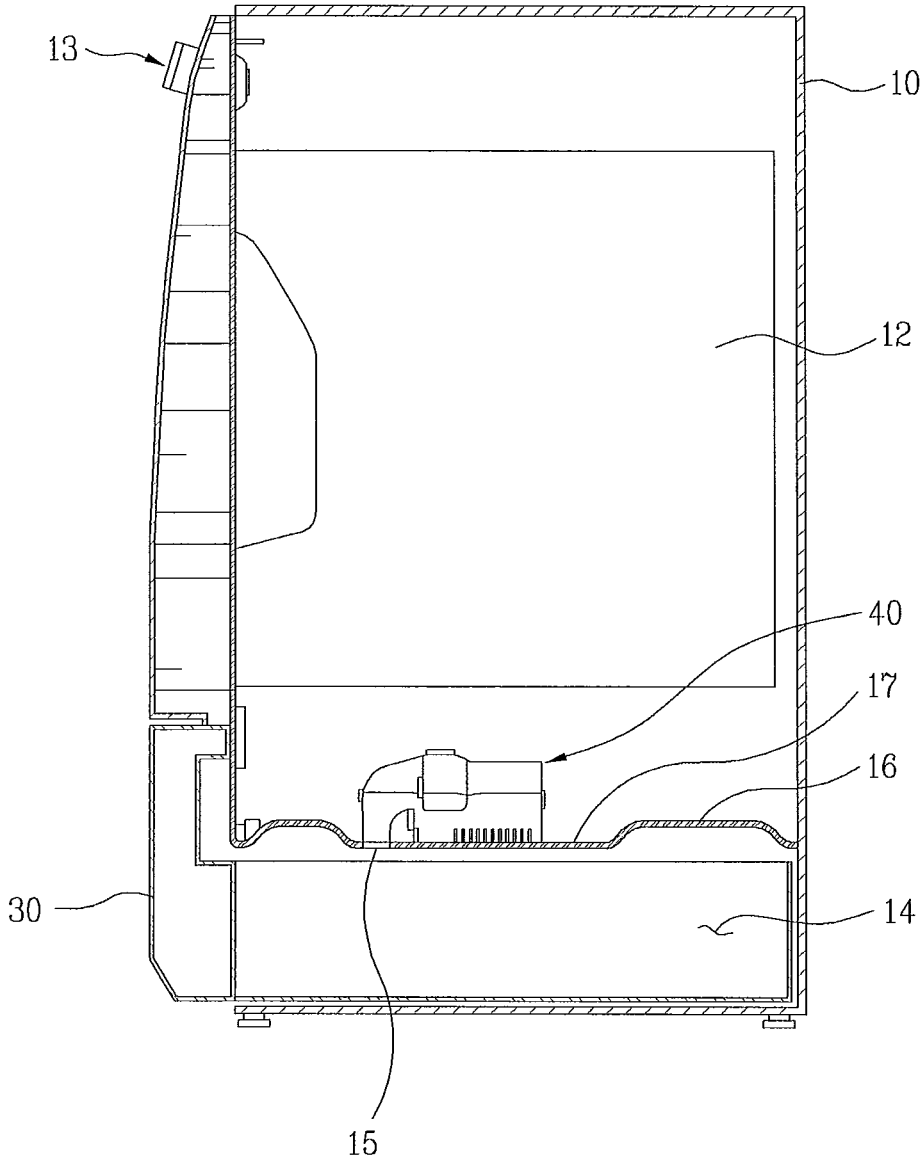
FIG. 2 is a sectional view illustrating line shown in FIG. 1.

In reference to FIGS. 1 and 2, a laundry machine includes a cabinet 10 and a partition 16. The partition 16 partitions the inner space into at least two spaces. The partition 16 may be a single partition, which will be described in detail later. The single partition 16 may partitions the inner space of the cabinet 10 into a first space or main space 12 and a second space or auxiliary space 14. Main laundry treatment for the laundry may be performed in the first space or main space 12. The first laundry treatment space 12 may include a laundry washing apparatus or a laundry drying apparatus. Auxiliary laundry treatment for the laundry may be performed in the second space or auxiliary space 14. A selector 13 is provided at the cabinet 10 to permit a user to select the desired laundry operations.

Here, the above main laundry treatment may mean conventional washing and/or drying operations, and auxiliary laundry treatment may mean& additional drying or refreshing operations for the laundry, or may mean drying or refreshing operations for small-sized laundry. The term 'refreshing' may mean a process of removing wrinkles, deodorizing, sanitizing, preventing static electricity, or warming the laundry by supplying air, heated air, steam, mist or water to the laundry. The term 'laundry' may include not only clothes but also all kinds of wearable objects and apparel such as shoes, socks, gloves and hats. Thus, laundry means all kinds of laundry to which laundering operations can be performed.

The cabinet 10 defines an exterior appearance of the laundry machine. Various components may be mounted in the cabinet 10. A rotatable drum 20 may be provided in the first space 12 inside the cabinet 10, and a detachable drawer 30 may be provided in the second space 14. The drum 20 and the drawer 30 are each configured to receive laundry therein. If the laundry machine is configured as a washing machine or a single appliance having both washing and drying functions, a tub (not shown) for accommodating wash water may be further provided, and the drum 20 may be provided within the tub.

The cabinet 10 may be formed of two separate members to include the first space 12 and second space 14. More particularly, the cabinet 10 may included a pair of first sidewalls at opposing sides of the first laundry treatment space 12, and a pair of second sidewalls at opposing sides of the second laundry treatment space 14, the pair of first sidewalls being contiguous with the pair of second sidewalls.

Alternatively, the cabinet 10 may be formed of a single member. In one embodiment, the first space 12 and the second space 14 are formed within the cabinet 10 formed of a single member. More particularly, the cabinet 10 may include a first sidewall and a second sidewall, each of the first and second sidewalls extending continuously and uninterrupted from the first laundry treatment space 12 to the second laundry treatment space 14, as shown, for example, in FIG. 15. If the first space 12 and the second space 14 are formed in the cabinet 10 formed of the single member, the assembly work of the cabinet 10 will be simple and the necessary time for assembly will be reduced accordingly.

According to the washing machine of this embodiment, the cabinet 10 formed of a single member includes the first space 12 and the second space 14, and it further includes the partition 16 which partitions the inner space of the cabinet into the first space 12 and the second space 14. The partition 16 may be embodied as a wall located within the cabinet 10 that extends between the first sidewall and the second sidewall. The partition 16 divides the inner space horizontally into an upper space corresponding to the first space 12 and a lower space corresponding to the second space 14. However, the present invention is not limited to the above.

That is, according to this embodiment, the cabinet 10 includes the partition 16 which is simultaneously employed as a base of the first space 12 and as a top cover of the second space 14.

More particularly, the partition 16 has a first side and a second side, the first side being exposed to the first laundry treatment space 12, and the second side being exposed to the second laundry treatment space 14. Because the single partition 16 is employed as the base of the first space 12 and the top cover of the second space 14, the assembly work will be remarkably simple and the time necessary for the assembly work will be reduced, compared with a case of including a separate base of the first space 12 and a separate top cover of the second space 14.

The provision of a single partition 16, as compared to a separate partition for each of the first and second spaces 12, 14, provides a simple structure for the laundry machine as a whole, and provides a good overall appearance to the laundry machine. In addition, the use of a single partition 16 simplifies assembly, and reduces costs due to the reduction in necessary material as compared with the use of separate partitions. Finally, a single partition 16 permits effective utilization of the first and second spaces 12, 14, and ease of access to the first space 12.

In addition, the laundry machine may further include an air supply unit 40 for supplying air or heated air to the second space 14.

The air supply unit 40 may be provided in the first space 12 and it is envisioned that the air supply unit is provided at a top surface of the partition 16. The partition 16 includes an aperture 15 therein so that air is supplied through the partition 16 and into the second laundry treatment space 14. The air supply unit 40 includes an air outlet that may be directly connected to the aperture 15 in the partition 16. The aperture 15 is located in a central portion of the partition.

The rotatably oriented drum 20 may be provided within the first space 12 and the drawer 30 may be provided within the second space 14. The volume of the first space 12 may be substantially larger than the volume of the second space 14. As a result, to utilize the inner space efficiently, it is envisioned that the air supply unit 40 is provided in the first space 12, rather than in the second space 14.

Such an arrangement permits the amount of interior volume of the second space 14 available to receive laundry to be maximized. In addition, providing the air supply unit 40 outside of the second space 14 simplifies the structure of the second space 14 and provides more freedom of design of the second space 14. Finally, because the interior of the second space 14 is readily accessible by a user via the drawer 30, placing the air supply unit 40 in an area other than the second space 14 provides an additional level of safety for the user.

The arrangement of the air supply unit 40 in the first laundry treatment space 12 with the air being supplied through the aperture 15 in the partition 16 provides a mainly downwardly-directed airflow into the second laundry treatment space 14. This downwardly-directed airflow is particularly beneficial for drying or treating shoes 100, because the air is provided downwardly to the upper of the shoe 100 to envelope the upper of the shoes 100 with the airflow, in contrast to a horizontal airflow which may only be directed at one side of a shoe, or an upwardly directed airflow which would be blocked by the sole of the shoe.

In addition, the downwardly-directed airflow is directed toward the bottom of the drawer and then will tend to spread out in all directions, providing well distributed air flow and reducing possible dead zones with little or no airflow in the drawer 30.

More particularly, the drawer 30 includes a bottom wall and a plurality of sidewalls that define an enclosed space having an open top side. The height of the sidewalls may be less than the width and depth dimensions of the drawer 30 so that the outlet of the airflow from the air supply unit 40 is relatively close to the bottom of the drawer so that the drawer bottom tends to redirect the downwardly-directed airflow outwardly in all directions. The drawer bottom and the plurality of side walls may be configured to prevent air from passing therethrough so as to maximize the amount of air that is redirected upwardly.

However, it is envisioned that the drawer bottom and/or the drawer sidewalls may include one or more apertures, such as a series of small ventilation holes, mesh or screening, to permit some of the airflow to pass therethrough.

The air supply unit 40 may be detachably provided on the partition 16, and more particularly, on the upper side of the partition 16. Here, a recess portion 17 may be provided on the partition 16 to accommodate the air supply unit 40. More specifically, a central portion of the partition 16 includes a recessed portion (or recess) 17 extended downwardly in an upper side of the partition 16, and as such, a lower side of the partition includes an upwardly extended portion surrounding the central portion, the details of which will be described later in the discussion regarding airflow recirculation.

The drum 20 is positioned in the first space 12 above the partition 16, and therefore it is possible that water may fall on the partition 16 because of the rotation of the drum during a washing, rinsing or drying-spinning cycle. As a result, the recess portion 17 may also collect the water falling onto the partition 16. In addition to that, the recess portion 17 accommodates the air supply unit 40. As a result, although not shown in the drawings, a water drainage structure may be provided at a predetermined portion of the recess portion 17 to drain the collected water without contacting the air supply unit 40. Alternatively, a bottom surface of the recess portion 17 may slope enough so that the collected water does not flow toward the air supply unit 40.

In reference to FIG. 2, the air supply unit 40 may be provided on the partition 16, and it can supply heated air to the second space 14. Specifically, the air supply unit 40 heats air from inside the first space 12 of the cabinet 10 and supplies the heated air to the second space 14. Here, the air inside the first space 12 will flow downwardly toward the second space 14 after being heated by the air supply unit 40. The downwardly-directed airflow is directed toward the bottom of the second space 14 and then will tend to spread out in all directions, providing well distributed air flow and reducing possible dead zones with little or no airflow in the second space 14.

Thus, the first space 12 forms a predetermined space where air is drawn into the air supply unit 40, that is, an air drawing space, and the second space 14 forms a predetermined space where air inside the air supply unit 40 is discharged, that is, an air discharging space. From a view of the air supply unit 40, the first space 12 is positioned on an air drawing path and the second space 14 is positioned on an air discharging path. As a result, an auxiliary inlet or outlet path for the air supply unit 40 does not have to be provided. The air supply unit 40 is configured to supply the air into the second laundry treatment space 14 without passing through the drum 20.

Figure 3:
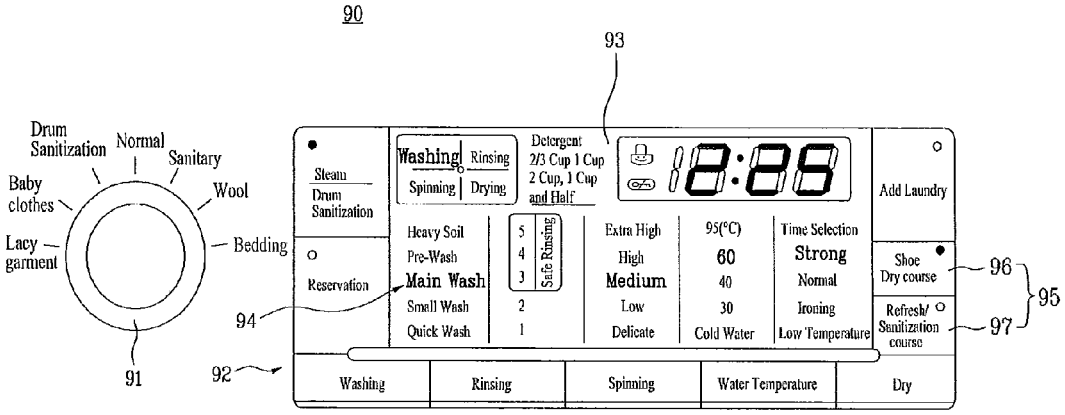
FIG. 3 is a front view illustrating a control panel applicable to the laundry machine shown in FIG. 1.

FIG. 3 is a front view illustrating a control panel 90 applicable to the laundry machine shown in FIG. 1.

In reference to FIG. 3, a control panel 50 may include a selection part for a user to select an operation course for the drum 20 and the air supply unit 40. That is, the control panel 90 ma be configured as an operation course of the air supply unit 40 as well as the drum 20 for the user to select. In reference to the drawing, the control panel 90 will be described.

The control panel 90 may include a first selection part 91 for selection of the operation course of the drum 20 and a second selection part 95 for selection of the operation course of the air supply unit 40.

The user may select various operation courses of the drum 20, for example, a standard, bedding, underwear or the like by using the first selection part 91. Here, the control panel 90 may include a main display part 93 capable of displaying operation information of the drum 20 to the user. The main display part 93 may display operation information of the air supply unit 40, together with the operation information of the drum 20.

The control panel 90 may further include an additional selection part 92 for the user to change conditions of a washing, rinsing, spinning and/or drying cycle composing the selected course. In case of pushing each button of the additional selection part 92, the user can adjust the kind of the washing, the number of the rinsings, the rpm of the spinning, the temperature of wash water or the like. If the condition for each cycle is adjusted, adjusted condition for each course may be displayed in an additional display part 94 which will be described later.

The second selection part 95 allows the user to select an operation course of the air supply unit 40. Here, at least two operation courses may be provided and the number of the courses is not limited but adjustable appropriately. According to this embodiment, the second course selection part 95 may include two operation courses of the air supply unit 40, for example, shoes dry course selection part 96 and a refresh/sanitary course selection part 97.

If pushing the shoes dry course selection part 96 and the refresh/sanitary course selection part 97 repeatedly, courses preset different according to the kind of the shoes may be selected. In addition, air conditions such as the dry temperature of the shoes and the amount of the air ventilation and the like may be preset different according to each course. This will be described in detail later.

A display part may be provided in a predetermined portion of the control panel 90 to display information on the air supplied from the air supply unit 40.

The display part includes a main display part 93 and an additional display part 94. The main display part 93 may display information on the operation of the drum and the operation of the air supply unit 40.

Specifically, the main display part 93 is provided in the control panel and it may display the information of the drum 20, for example, the tile of the selected course or the remaining time of the operation of the selected course. Moreover, the main display part 93 may display information on the air supplied from the air supply unit 40, for example, the drying temperature or the ventilation amount of the air.

The additional display part 94 displays specific information on cycles of each course. The user may adjust conditions for the cycles included in each course, for example, the kind of the washing, the number of the rinsings, the rpm of the spinning, the temperature of the wash water or the like. In addition, if adjusting the conditions for each cycle as mentioned above, the changed conditions for each course may be displayed in the additional display part 94.

Figure 4:
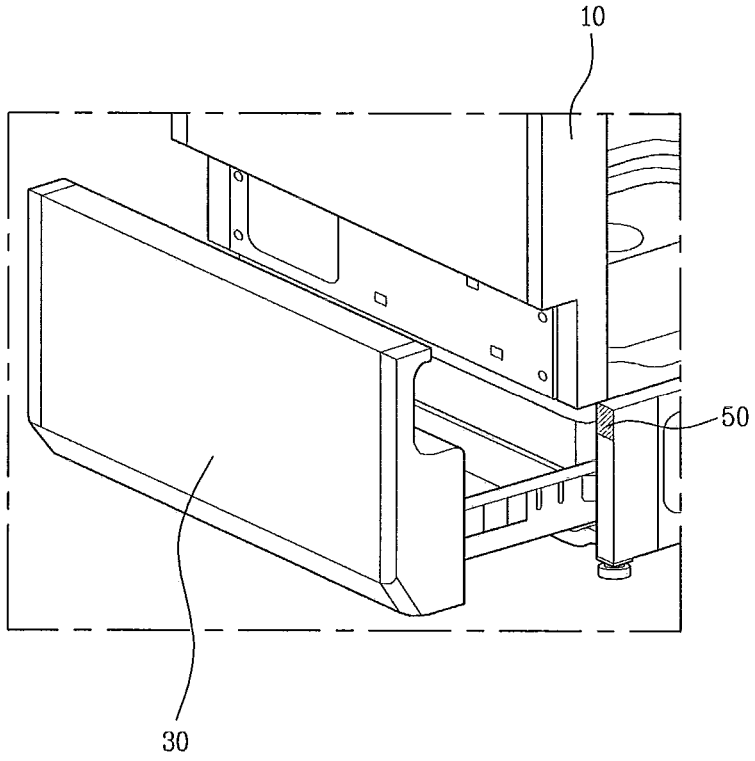
FIG. 4 is a perspective view illustrating affront of a drawer detachably provided in the cabinet shown in FIG.

FIG. 4 is a perspective view illustrating a front view of the detachable drawer 30 provided in the second space 14 of the cabinet 10.

In reference to FIG. 4, the drawer 30 has an enclosed space with an open top. More particularly, the drawer 30 includes a bottom wall and a plurality of sidewalls that define an enclosed space having an open top side. The drawer 30 substantially occupies an entirety of the second laundry treatment space 14. An accommodating space is formed in the drawer 30 and the accommodating space receives the laundry therein.

Undesirable smells of laundry used one or two times may be removed by a deodorization filter (not shown) or a fragrance addition unit (not shown), which may be further provided in the drawer 30 according to this embodiment. The deodorization filter removes the odors of the laundry and the fragrance addition unit supplies fragrance to the laundry such that the user may feel pleasant when wearing the laundry. The filter or fragrance addition unit may be provided in the second space 14, specifically, in a front portion inside the drawer 30.

During the operation of the air supply unit 40, the user may happen to open the drawer 30 by the user's mistake or the like. Therefore, the laundry machine according to this embodiment may further include a sensing part 50 for sensing a position of the drawer 30.

The sensing part 50 may be configured as a limit switch sensing whether the drawer 30 is sliding outward.

In case the drawer 30 is sliding open outwardly, the sensing part 50 generates an open signal, and the open signal is transmitted to a control part (not shown) of the laundry machine. The control part controls the air supply unit 40 according to the open signal of the sensing part 50. Once receiving the open signal from the sensing part 50, the control part powers off the air supply unit 40 to prevent heated air from being directed toward the user. If the sensing part 50 is configured as a limit switch, the limit switch directly switches off the air supply unit 40 when the drawer 30 is sliding open.

Referring to FIG. 6, the air supply unit 40 according to this embodiment includes a fan 51 for blowing air inside the air supply unit 40, and a heating part 60 for heating the air. A control part is provided that controls the air supply unit 40. The control part powers off the heating part 60 first, and then the fan 51 is powered off after a predetermined time period has elapsed after the heating part 60 has been turned off. If the heating part 60 is operated, the temperature inside the cabinet 10 increases. When the fan is turned off after a predetermined time period has elapsed after turning off the heating part 60, for example, one or two minutes, the air inside the cabinet 10 will be circulated during the one or two additional minutes, and the temperature inside the cabinet 10 will decrease accordingly.

Although not shown in the drawings, the laundry machine according to this embodiment may include an alarming part configured to warn the user visually or auditorily whether the drawer 30 is sliding open. Once the sensing part 50 generates and transmits the open signal to the control part, the control part turns off the air supply unit 40 and it controls the alarming part to inform the user of the open state of the drawer 30. Then, the user notices that the drawer 30 is open and takes corrective action, for example, closing the drawer 30 and re-operating the air supply unit 40.

If the operation of the laundry machine is stopped by the open state of the drawer 30, the laundry machine may display the remaining amount of the operation time of the selected course such that the user may recognize how much time of the selected course is remaining, and the user may determine to re-operate the laundry machine or to take out the laundry.

The air supply unit 40 which supplies heated or unheated air to the drawer 30 will now be described in detail.

Referring to FIGS. 5 and 6, the air supply unit 40 according to this embodiment includes a housing 42. The housing 42 is detachably connected to a top surface of the partition 16 and it forms an air flow path.

The housing forms the air flow path through which the air flows along, and in the housing 42 may be provided the fan 51, the heating part 60 and the sub-control part which will be described later. Here, the housing 42 would be formed as one body that includes an upper housing 44 and a lower housing 46. The lower housing 46 is detachably coupled to the top surface of the partition 16 by, for example, one or more projections 94 received in corresponding slots in the partition 16, and one or more bosses 92 through which a fastener is passed and secured to the partition 16.

The upper housing 44 is detachably coupled to the lower housing 46 by a plurality of hooks 45 provided on the upper housing 44 and a plurality of engaging members 47 provided on the lower housing 46. The detachable upper and lower housings 44 and 46 make it simple and convenient to repair inner components of the air supply unit 40 for maintenance.

A plurality of ribs 90 may be provided on the lower housing 46 to reinforce the lower housing 46. The ribs 90 may be arranged along both sides of the lower housing 46. The housing 42 may also include wire fixing members 82 and 84 for constraining wires connecting internal components of the air supply unit 40 with the outside.

The air supply unit 40 may be positioned on the top surface of the partition 16, that is, below the drum 20 (see FIG. 1) as mentioned above. When the drum 20 is operated, water may fall on the air supply unit 40. If the water enters into the housing 42, the inner components of the housing 42 such as the heating part 60 could malfunction or be damaged. Especially, if the upper housing 44 and the lower housing 46 of the housing 42 are formed of separate members, respectively, the water may pass through the connection portion between them. Because of that, the air supply unit 40 according to this embodiment may include a water penetration preventing part for preventing the water from penetrating through the connection portion between the upper housing 44 and the lower housing 46.

Specifically, the water penetration preventing part includes a first extending portion 41 which extends downward from an edge of the upper housing 44 and a second extending portion 48 which extends upward from an edge of the lower housing 46.

Here, the first extending portion 41 is formed along a rim of the upper housing 44, encircling a predetermined portion of a rim of the lower housing 46, and thereby covering the rim of the lower housing 46. The second extending portion 48 is coupled to the first extending portion 41, specifically, to an inside of the first extending portion 41. As a result, the water on the top of the housing 42 flows along a surface of the first extending portion 41 sequentially, not passing into the housing 42 along the connection portion, and it falls toward the partition 16.

As mentioned above, the path of the airflow is in the housing. The path is formed between the lower housing 46 and the upper housing 44, and air flows along the path shown as an arrow in FIG. 6. The fan 51 for blowing air along the path and the heating part 60 for heating the air may be provided inside the housing. Although it is shown in FIG. 6 that the fan 51 and the heating part 60 are arranged sequentially along the flowing direction of the air so that the fan 51 blows air to the heating part 60, the present invention is not limited thereto and it is also possible to arrange the heating part 60 and the fan sequentially so that the fan 51 draws air from the heating part 60. The fan 51 is a centrifugal fan in the embodiment shown. However, it is envisioned that alternative fan designs such as an axial fan or scirocco fan may be used.

Once the fan 51 is put into operation, air outside the housing 42 is drawn into the housing 42 via an inlet 43. Here, it is envisioned that the rpm of the fan 51 is adjustable. Since the rotation speed of the fan 51 is adjustable, the amount of the air supplied by the fan 51 may be adjustable. The air drawn into the housing 42 is heated by the heating part 60 and the heated air is discharged through an outlet 49. In this case, the outlet 49 is connected with a the aperture 15 (see FIG. 2) forming a heated air inlet in the partition 16, and is directed toward downwardly. It is envisioned that the outlet 49 is approximately perpendicular to the heated air inlet 15, and is directly connected with the heated air inlet 15. As a result, the heated air may flow downwardly toward the second space 14, that is, the drawer 30.

FIG. 7 is a diagram schematically illustrating the flow of the air supplied to the drawer 30 by the air supply unit 40.

Referring to FIG. 7, the air discharged via the outlet 49 passes the heated air inlet 15, and the air flows toward a side upper portion inside the drawer 30 via a center lower portion. Because of that, a dead zone inside the drawer 30, which air fails to reach, may be reduced as much as possible.

Also, as shown in FIG. 2, the lower side of the partition 16 may have an upwardly extended portion surrounding the recessed portion in the upper side of the partition 16. This upwardly extended portion may include inclined portions 162 configured to redirect airflow inwardly toward the central portion of the partition 16, and downwardly away from the partition 16, and back toward the drawer 30.

This arrangement permits some of the air to be recirculated, which may promote heating, drying or other treatment of laundry in the drawer 30. As shown in FIG. 6, a gap 32 is provided between the partition 16 and the drawer 30 to permit air to pass therethrough and exit the drawer 30 for subsequent exiting of the second laundry treatment space 14.

Also, if the laundry is put on a bottom surface of the drawer 30, air can contact with the laundry as much as possible. The bottom of the drawer 30 tends to redirect the downwardly-directed airflow outwardly in all directions toward the drawer sidewalls. Thereafter, the drawer sidewalls tend to redirect the airflow upwardly toward the partition 16. Finally, the partition 16 tends to redirect the airflow inwardly toward the central portion of the partition 16, where the airflow joins with the downwardly-directed airflow, and is recirculated.

The air supply unit 40 may include a sensor part capable of sensing a temperature of air to control on and off operation of the heating part 60. The sensor part measures the temperature of the air supplied from the air supply unit 40 or the temperature of the air inside the second laundry treatment space 14 directly. This configuration will be described as follows.

Referring to FIGS. 5 and 6 again, the air supply unit 40 according to this embodiment may further include a first sensor part 70 which senses the temperature of the heated air. The heating part 60 may be controlled according to the temperature values monitored by the first sensor part 70 to supply the heated air.

This first sensor part 70 may be provided in a predetermined portion inside the path and it is envisioned that the first senor part 70 is provided at an end of the path, that is, adjacent to the outlet 49. The operation of the heating part is controlled according to the temperature values measured by the first sensor part 70 such that the temperature of the air supplied to the second laundry treatment space 14 may be controlled.

The first sensor part 70 may be installed by a method of forced insertion or using adhesive. It is envisioned that the first sensor part 70 is fixed securely enough to endure the pressure of the air blown by the fan 51. In reference to corresponding drawings, the temperature sensor will described.

FIG. 8 is a perspective view illustrating a fixing unit for fixing the first sensor part 70, seen upward under the housing 42.

Referring to FIG. 8, the fixing unit includes a fixing plate 72 for securing the first sensor part 70 and a fixing member 74 extending from the housing 42 to fix a position of the fixing plate 72.

The first sensor part 70 may pass a through hole 71 provided in the fixing plate 72. The first sensor part 70 may be also fixed by inserting through the through hole 71 forcibly or adhesives. Here, a securing hole 76 may be provided in the fixing plate 72 for the first sensor part 70 to be secured to the housing 42. A securing member (not shown) passes the securing hole 76 and the housing such that the fixing plate 72 is secured to the housing 42. Thus, the first sensor part 70 is fixed to the housing 42 primarily and to the fixing plate secondarily. The housing 42 may further include a fixing portion 75 the first sensor part 70 passes. The first sensor part 70 passes through the fixing portion 75 and it is fixed to the fixing plate 72 securely.

In case the fixing plate 72 is connected to the housing 42, a fixing member 74 may be further provided. The fixing member 74 is connected with the housing 42, and fixes a position of the fixing plate 72. The fixing member 74 may extend from the housing 42. A fixing recess 73 corresponding to the fixing member 74 may be provided in the fixing plate 72. The fixing recess 73 is provided at a predetermined portion of the fixing plate 72. The fixing member 74 is inserted in the fixing recess 73. Once an end of the temperature sensor 70 is inserted in the through hole 71 and the fixing member 74 is received in the fixing recess 73, the fixing plate 72 is fixed and then the worker can pass the securing member through the securing hole 76.

When the heating part 60 is controlled by the temperature of the supplied air sensed by the first sensor part 70, a single control part may be provided or two or more control parts may be provided.

If at least two control parts are provided, for example, a main-control part and a sub-control part, a main-control part controls an overall operation of the drum 20 and the air supply unit 40. The temperatures measured by the first sensor part 70 may be transmitted to the main-control part.

The main-control part may control the heating part 60 and the fan 51 of the air supply unit 40 according to a corresponding signal transmitted by the temperature sensor. In this case, a command signal generated by the main-control part is transmitted to the sub-control part provided in the air supply unit 40. Hence, the sub-control part controls the heating part 60 and the fan 51 according to the command signal of the main-control part. If receiving the command signal from the main-control part, the sub-control part may perform only the on and off control of the heating part 60 or the fan 51 in order to simplify the configuration.

FIGS. 9 and 10 are sectional views partially illustrating the first sensor part capable of measuring the temperature inside the second laundry treatment space 14 directly.

In reference to FIGS. 9 and 10, the first sensor part 70 may be provided in the second laundry treatment space 14, toward inner space of the second laundry treatment space 14. In case the drawer 30 is provided in the second laundry treatment space 14, it is envisioned that the first sensor part 70 is provided in an upper portion of the second laundry treatment space 14 to avoid interference with the movable drawer 30.

Specifically, FIG. 9 shows the first sensor part 70 provided in the partition 16, projected toward the second laundry treatment space 14. In this case, to avoid the interference between the first sensor part 70 and the drawer 30, the first sensor part 70 may be provided in the other portion of the partition 16 except the recess portion 17. Although not shown in the drawing, an opening with a predetermined size may be provided in a rear side of the drawer 30 to avoid the interference with an end of the first sensor part 70.

Referring to FIG. 10, the first sensor part 70 is provided in the partition 16. More particularly, the first sensor part 70 is not projected toward the inner space of the second laundry treatment space 14. The first sensor part 70 is provided in a predetermined portion of the partition 16. The first sensor part 70 is provided in a projecting portion 18 projected toward the first laundry treatment space 12. Therefore, the first sensor part 70 may not be projected toward the second space 14. That is, the projecting portion 18 is projected toward the first space 12 from the second space 14. As a result, even when the drawer 30 sliding moves, the drawer 30 may not interfere with the first sensor part 70.

FIG. 11 is a perspective view illustrating only the heating part 60 shown in FIG. 6.

Referring to FIG. 11, the heating part 60 provided in the air supply unit 40 according to this embodiment may include a heater 61 for heating the blown air, and a case 62 for accommodating the heater 61. The case 62 forms a path through which air flows and it supports the heater 61 to prevent the heat produced by the heater 61 from being transferred to the housing 42 (see FIG. 5).

Various heaters may be used within the air supply unit, including a PTC heater (Positive Temperature Coefficient Heater). A PTC heater is desirable because it is easy to control.

A single heater may be provided. However, it is envisioned that the heater may be horizontally divided into a first heater 61*a* and a second heater 61*b* along the path. The first and second heaters 61*a* and 61*b* are accommodated in an upper case 64 and a lower case 66, respectively. A partition 65 may be provided between the first and second heaters 61*a* and 61*b* to prevent the overheating of the heaters 61*a* and 61*b*.

Either or both of the heaters 61*a* and 61*b* may be operated selectively and simultaneously such that the air may be heated appropriately according to the amount of the air in order to save energy. Specifically, if the air amount is relatively small, either of the first and second heaters 61*a* and 61*b* is operated to heat the air. If the air amount is relatively large, both of the first and second heaters 61*a* and 61*b* are operated simultaneously to heat the air.

The case 62 prevents the heater 61 from directly contacting the inside of the housing 42, and supports the heater 61 to form the air path. As shown in FIG. 11, the case 62 may support the heater 61 in a way that does not interfere with the flow of the air along the heater 61. Because of that, the case may be fabricated with heat-resistant material having low heat conductivity, or heat insulating material.

The case 62 may be formed integrally of a single member, and it is envisioned that the case 62 may be formed of separate members which will be assembled. Specifically, the case 62 shown in FIG. 11 includes the upper case 64 and the lower case 66 which are coupled to each other. Providing the case 62 configured of the separate members makes it possible to perform disassembling and re-assembling operations easily for repairing work.

Because the heater 61 according to this embodiment is closely adjacent to the housing 42 of the air supply unit 40, the case 62 may prevent the heat of the heater 61 from being transmitted to the housing 42 along a vertical direction, not simply preventing the heater 61 from contacting with the inside of the housing 42. That is, although the heat of the heater 61 could be transmitted to the air flowing along the path, the heat will not be transmitted toward the housing 42 positioned opposite to the air path.

Specifically, as shown in FIG. 11, the upper case 64 covers the upper heater 61*a* and the lower case 66 covers the lower heater 61*b*. The air passes the case 62 via the open portions of the upper case 64 and the lower case 66, for example, from a left to right direction. In this way, the heater 61 may not directly contact the housing 42 by way of the case 62, and the heat generated by the heater 61 may be prevented from flowing to the walls of the housing 42 by the upper and lower cases 64 and 66. Additional safety features are incorporated into the heating part 60. For example, the heating part 60 includes contact terminals for supplying electricity to the heater 61. As shown in FIG. 7, the contact terminals are spaced from one another in both a horizontal direction and a vertical direction.

If the heating part 60 is operated without sufficient supplied air, the temperature of the heater 61 may increase too much, and it is possible that the heater 61 may be damaged. Because of that, an overheat prevention means may be provided in this embodiment.

Specifically, the heating part 60 according to this embodiment may further include a second sensor part 68 which senses the temperature of the heater 61. In addition to the first sensor part 70 for sensing the temperature of the heated air, the second sensor part 68 senses the temperature of the heater 61. The second sensor part 68 is positioned adjacent to the heater 61 to monitor the temperature of the heater 61. The measured temperature values may be transmitted to the control part including the main-control part and the sub-control part. If the transmitted temperature is over a predetermined value, the control part, specifically, the main-control part, determines that the heater 61 is overheated and it controls the heater 61 to be turned off. In case the sub-control part is provided, the sub-control part receives a corresponding command from the main-control part and turns off the heater 61.

In addition to the second sensor part 68, a fuse 72 may be provided as an overheating prevention means for turning off the heater 61. As shown in FIG. 11, the fuse 72 may be provided in the case 62.

Specifically, an open portion 67 is provided in the upper case 64, and the thermal fuse 72 is positioned in the open portion 67. The heat of the heater 61 is transmitted to the thermal fuse 72 via the open portion 67 such that the heat may be sensed more efficiently.

If such an open portion 67 is formed, the heat of the heater 61 flows out of the case 62 via the open portion 67 and directly to the housing 42. As a result, the heating part 61 according to this embodiment includes a closing member 69 for closing the open portion 67 to prevent the heat of the heater 61 from directly flowing to the housing 42. The closing member 69 may be formed as a separate member and it is envisioned as shown in FIG. 11 that the closing member 69 may be formed integrally with the upper case 64. Here, the closing member 69 is configured to cover the open portion 67, and includes a bent portion, such that the heat may not flow toward the housing 42 via the open portion 67.

The fuse 72 is connected with the heater 61. If the temperature of the heater 61 increases beyond the predetermined temperature, the fuse 72 will cut off the electricity supplied to the heater 61 to prevent the overheating of the heater 61.

As shown in FIG. 11, the closing member 69 is oriented perpendicular to the direction of airflow through the heater 61 to protect the housing 42 from excess heat while permitting the fuse 72 to accurately detect a temperature of the heater 61 without being unduly affected by airflow through the open portion 67. For example, excess air flow through the open portion 67 could cause the fuse 72 to inaccurately sense the temperature of the heater 61, and the heater 61 may not be adequately protected from overheating.

Next, a control method of the laundry machine having the above configuration will be described as follows.

FIG. 12 is a flow chart illustrating a control method of the laundry machine according to an exemplary embodiment of the present invention.

In reference to FIG. 12, after loading the laundry into the drawer 30, the user drives the air supply unit 40.

Hence, in case of treating the laundry according to the selected course of the air supply unit 40, the control part of the laundry machine compares the temperature measured by the first sensor part 70 with a first reference temperature to control the heating part 60 of the air supply unit 40.

Specifically, when starting the laundry treatment by the air supply unit 40, the control part drives the fan 51 to ventilate air into the drawer 30(S110). The control part compares the temperature of the air measured by the first sensor part 70 with the first reference temperature (S130).

The control part selectively drives the heating part 60 based on the result of the comparison and the control part supplies heated air (S150).

According to the control method of this embodiment, heated air is not supplied continuously during the laundry treatment time of the air supply unit 40. Alternatively, the heated air is supplied selectively by driving the heating part 60. As a result, the en operation time of the fan 51 may be relatively longer than the operation time of the heating part 60.

Specifically, the control part may not turn on the heating part 60 if the temperature of the air measured by the first sensor part 70 is over the first reference temperature or higher. The control part may turn on the heating part 60 if the temperature of the air measured by the first sensor part 70 is below the first reference temperature. Here, the first reference temperature may be adjustable according to an installation place and installation environments of the laundry machine and this embodiment presents 35° C.~45° C., for example.

After turning on the heating part 60, the control part of the laundry machine determines whether to drive the heating part 60 continuously during the operation time of the selected course (S170).

Specifically, the control part of the laundry machine controls the heating part 60 to be off and the fan 51 to be continuously on, if the temperature of the air measured by the first sensor part 70 is over a second reference temperature (S190).

The second reference temperature may be adjustable according to the installation place and installation environments of the laundry machine and this embodiment presents that the second reference temperature is preset to 55° C.~65° C., for example.

As a result, the control part controls the heating part 60 to be on and off such that the temperature of the air measured by the first sensor part 70 may be within a predetermined range. That is, the control part controls the heating part 60 for the temperature of the air measured by the first sensor part 70 to a range having approximately 10~20° C. temperature difference. This embodiment presents that the heating part 60 is controlled to be on and off such that the air temperatures measured by the first sensor part 70 may have a range between 35° C. and 55° C., or a range between 45° C. and 65° C., for example.

If the heating part 60 is turned off, the step of comparing the temperature of the air measured by the first sensor part 70 with the first reference temperature (S130) will perform again.

At this time, in case the step S130 re-starts, the first reference temperature for the heating part 60 to be on may be preset different with the first reference temperature preset in the first-start of S130. If the step S130 starts first time, the first reference temperature is preset approximately 35° C.~45° C. as mentioned above. However, if the step S130 re-starts two times or more, the first reference temperature may be preset substantially higher than the above first reference temperature preset in the first performance of the step S130. If the identical first reference temperature is applied to every time the step S130 re-starts, the temperature of the air measured by the first sensor part 70 may decrease below the temperature of 35° C.~45° C. This would influence efficiency of laundry drying.

Although not shown in the drawings, once the operation time period of the selected course in any above steps completes, a finishing step of turning off the heating part 60 and the fan 51 of the air supply unit 40 may be further included.

In this case, the heating part 60 may be turned off before a predetermined time period when the operation time of the laundry treating by the air supply unit 40 completes.

When the operation of the laundry treating by the air supply unit 40 completes and both of the heating part 60 and the fan 51 stop simultaneously, the inside of the cabinet 10 is relatively high temperature and thus the user would get burnt in case of taking out the laundry. Because of that, it is envisioned that the heating part 60 is turned off first before a predetermined time period, for example, one to three minutes when the treating time of the air supply unit 40 finishes.

In case the drawer 30 is sliding open, the control part may turn off the heating part 60 and the fan 51 by the sensing part 50.

Not with the case of the drawer 30 being open by the user's mistake or the like, the operation of the laundry machine may stops by the user's selection or pushing a stop button. Even in this case, the laundry machine would turn off the heating part 60 and the fan 50 51 of the air supply unit 40.

Here, it is envisioned that the fan 51 is turned off in a predetermined time period after the heating part 60 is turned off first even if the laundry machine is turned off by the openness of the drawer 30 or the user's selection.

More particularly, the control part controls the predetermined time period based on a temperature of a circumstance air.

If the temperature of the circumstance air is over a reference temperature, the control part controls the predetermined time period longer than reference time. In case that the temperature of the circumstance air is over the reference temperature, the control part determines that the temperature of the circumstance air is relatively high.

Therefore, the control part controls the predetermined time period longer than the reference time to cool the laundry.

Alternatively, in case that the temperature of the circumstance air is below the reference temperature, the control part determines that the temperature of the circumstance air is relatively low. Therefore, the control part controls the predetermined time period shorter than the reference time to warm the laundry.

As mentioned above, the control part controls the fan 51 to be on at a starting time of the operation of the air supply unit. Therefore, the control part can sense the temperature of the circumstance air by the first sensor part 70 when the fan 51 is only operated.

If the fan 51 is operated first, the air inside the first laundry treatment space 12 is supplied into the air supply unit 40. Because the cabinet 10 is not completely sealed, the air outside the cabinet 10 also can be supplied into the air supply unit 40. Therefore, the control part can sense the temperature of the circumstance air by the first sensor part 70.

When the laundry machine is stopped by the openness of the drawer 30 or the user's selection, the laundry machine may display the remaining time of the laundry treatment of the selected course. As a result, the user could recognize the remaining time of the laundry treatment of the selected course, and he/she may determine whether to re-start the laundry machine and whether to take out the laundry at the moment.

FIG. 13 is a flow chart illustrating a control method of the laundry machine according to another embodiment of the present invention.

Referring to FIG. 13, when the laundry treating by the air supply unit 40 starts, both of the heating part 60 and the fan 51 are controlled to be on (S210). That is a different configuration from the above control method shown in FIG. 12. From now on, the different configuration of this embodiment from the above control method shown in FIG. 12 will be described.

The control part of the laundry machine starts the laundry treating by the air supply unit and then controls both of fan 51 and the heating part 60 to be on (S210).

Hence, the control part determines whether to operate the heating part 60 during the laundry treating time by the air supply unit 40 (S230).

Specifically, in case that the temperature of the air sensed by the first sensor part 70 is over the second reference temperature, the heating part 60 is controlled to be off and the fan 51 to be on continuously (S250).

Hence, the temperature of the air sensed by the first sensor part 70 is compared with the first reference temperature (S270). If the temperature of the air sensed by the first sensor part 70 is below the first reference temperature, the heating part 60 is controlled to be on (S210) and otherwise the heating part 60 is controlled to be off continuously.

Although not shown in the drawings, any steps mentioned above may include the finishing step of turning off the heating part 60 and the fan 51 of the air supply unit 40 if the operation time period of the selected course in any above steps completes.

FIG. 14 is a flow chart illustrating a control method of the laundry machine according to a further embodiment of the present invention. This embodiment presents a control method for shoes as laundry objects and it will be described as follows.

In reference to FIG. 14, a control method according to this embodiment includes loading shoes in the drawer 30 (S610), selecting a treating course of the air supply unit 40 (S630), operating the air supply unit 40 according to the result of the selecting step (S650) and informing the user of the selected course completion (S670).

First of all, the user loads shoes to dry in the drawer 30 (S610). For example, the user may put the shoes in the drawer to sanitize shoes used for quite a time or to dry wet shoes.

Hence, the user may select a desired course of the air supply unit 40 (S630). The user may select a course according to the kind or the object of the shoe received in the drawer 30.

Specifically, in case that used shoes are wet, the user may select a dry course according to the kind of the shoe. For example, in case of drying leather shoes or non-leather shoes such as sneakers and the like, the user may select a leather shoe dry course or sneaker dry course.

In addition, the user may select a corresponding course according to an object of laundry treatment. Specifically, if shoes to dry are put on for a relatively short time, the user may wish to remove unpleasant smell of the shoes or remove humidity such as sweat soak in the shoes to keep the shoes in a fresh state. If then, 'refresh course' may be selected. If the user desires to sanitize shoes that are put on for a relatively long time, the user may select a sanitary course.

A method of selecting the above courses will be described. As mentioned above, laundry machine according to this embodiment may include the selection part 62 for selection of the shoe dry course and the selection part 64 for selection of the refresh/sanitary course. If the user pushes the shoe dry course selection part 62 continuously, the leather shoe dry course and the sneaker dry course may be selected sequentially. If the user pushes the refresh/sanitary course selection part 64 continuously, the refresh course and the sanitary course may be selected sequentially.

As mentioned above, the drying temperature and the air ventilation amount may be preset different according to each course. In case the control part controls the dry temperature of the shoes, the temperature inside the drawer may be controlled by the sensor part provided in the drawer 30 directly or the temperature of the air may be controlled by the sensor part provided in the air supply unit 40. Also, the ventilation amount of the air may be controlled by the adjustment of the fan 51.

Each course will be described in detail as follows.

First of all, once the user selects the sneaker dry course, the control part controls the temperature of the air over a first preset temperature below a second preset temperature and it controls the rotation number of the fan 51 to a first rotation number. For example, according to this embodiment of the present invention, the first preset temperature may be preset approximately to 30° C. and the second preset temperature may be preset approximately to 60° C. As a result, the control part may controls the lowest temperature of the air to be approximately 30° C. and the highest temperature of the air to be approximately 60° C.

Compared with the leather shoes, the sneakers are heat-resistant. However, if the sneakers are dried at 60° C. or higher, a connection area using adhesives or printed area would be deformed. If the sneakers are dried at relatively too low temperature, the drying time would he lengthened unnecessarily. As a result, in the sneaker dry course, the highest temperature of the air may be controlled not to increase the temperature of 60° C.

In the meanwhile, if the user selects the leather shoe dry course, the control part controls the temperature of the air to be below a third preset temperature and the rotation number of the fan to be the first rotation number or a second rotation number. For example, the first preset temperature may be preset approximately to 50° C. and the first rotation number may be preset higher than the second rotation number.

Compared with synthetic material shoes such as sneakers, the leather shoes are relatively susceptible to heat. It is preferable that the leather shoes are dried below 50° C. to prevent deformity of leather material.

In addition, if the user selects the refresh course, the control part controls the air temperature over a fourth preset temperature below the first preset temperature and it controls the rpm of the fan 51 at the first rotation number or the second rotation number.

The object of the refresh course is to remove unpleasant smell or humidity such as sweat of the shoes and it is preferable that relatively low temperature air is supplied. If not-heated air is supplied, the time required for the refresh course would be lengthened. For example, the fourth preset temperature may be preset approximately to 20° C. As a result, once the refresh course is selected, the control part controls the air temperature over 20° C. below 30° C.

If the user selects the sanitary course, the control part controls the air temperature to be the second preset temperature and the rotation number of the fan 51 to be the second rotation number. The object of the sanitary course is to remove bad bacteria of the shoes. As a result, it is preferable that relatively high temperature air stays in the shoes to sanitize for a relatively long time as possible.

In case of controlling the air temperature to be the second preset temperature, it is preferable that an average temperature of the air is controlled to be the highest one in each of the courses. In case of controlling the rotation number of the fan 51 to be the second rotation number, an average rotation number of the sanitary course is the lowest on in each of the courses. Because of the increased air temperature increases and the decreased rotation number of the fan, high temperature air could remain in the shoes for a long time as possible.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a cabinet;

a first laundry treatment space including a drum configured to receive laundry therein and wash the laundry;

a second laundry treatment space including a drawer configured to receive laundry therein and dry the laundry;

a single partition for partitioning an inner space of the cabinet into the first laundry treatment space and the second laundry treatment space, the single partition including a recess portion extending downwardly in an upper side of the single partition;

an air supply unit detachably mounted at the recess portion of the single partition in the first laundry treatment space and configured to supply air from the first laundry treatment space into the drawer of the second laundry treatment space independent of air supply to the drum, the air supply unit comprising:

a fan;

a heating part;

a first sensor part for sensing a temperature of air supplied by the air supply unit; and a housing, wherein the fan, the heater, an air inlet and an air outlet are provided at the housing;

a sensing part sensing whether the drawer provided in the second laundry treatment space is moved open; and a control part configured to control the heating part based on a sensed temperature of the first sensor part, a first reference temperature and a second reference temperature, control the heating part to be off in case the drawer is moving open, and control the fan to be off after a predetermined time period.

2. The laundry machine of claim 1, wherein the control part controls the heating part and the fan to be off after an operation time period of selected course.

3. The laundry machine of claim 1, wherein the control part controls the fan to be on at a starting time of the operation of the air supply unit.

4. The laundry machine of claim 3, wherein the control part controls the heating part to be on, in case the sensed temperature is below the first reference temperature.

5. The laundry machine of claim 4, wherein the control part controls the heating part to be off, in case the sensed temperature is over the second reference temperature.

6. The laundry machine of claim 5, wherein a driving time of the fan is substantially longer than a driving time of the heating part.

7. The laundry machine of claim 1, wherein the control part is further configured to control a temperature of the supplied air to be within a predeteimined range of 10 to 20° C.

8. The laundry machine of claim 1, wherein the first sensor part is provided at an end of a path through which air is discharged from the air supply unit.

9. The laundry machine of claim 1, wherein the control part controls the predetermined time period based on a circumstance temperature.

10. The laundry machine of claim 9, wherein the control part controls the predetermined time period longer than reference time, in case the circumstance temperature is over a reference temperature.

11. The laundry machine of claim 9, wherein the control part controls the fan to be on at a starting time of the operation of the air supply unit, and wherein the control part measures the circumstance temperature by the first sensor part when the fan is on.

12. The laundry machine of claim 1, further comprising a display part displaying information on the air supply unit, wherein the control part displays the remaining time of the operation of the air supply unit in the display part.

13. The laundry machine of claim 1, further comprising a second sensor part for sensing a temperature of the heating part, wherein the control part controls the heating part to be off in case that the heating part is overheated.

14. The laundry machine of claim 13, further comprising a fuse for turning off the heating part, in case the heating part is overheated.

15. The laundry machine of claim 1, wherein the control part controls the fan and the heating part to be on at a starting time of the operation of the air supply unit.

16. The laundry machine of claim 15, wherein the control part controls the heating part to be off, in case the sensed temperature is over the second reference temperature, and the control part controls the heating part to be on, in case the sensed temperature is below the first reference temperature.

* * * * *